US009605575B2

(12) United States Patent
Yahata et al.

(10) Patent No.: US 9,605,575 B2
(45) Date of Patent: Mar. 28, 2017

(54) REDUCING AGENT SUPPLYING DEVICE

(71) Applicant: DENSO CORPORATION, Kariya, Aichi-pref. (JP)

(72) Inventors: Shigeto Yahata, Toyoake (JP); Masumi Kinugawa, Okazaki (JP); Yuuki Tarusawa, Kariya (JP); Keiji Noda, Kuwana (JP); Mao Hosoda, Kariya (JP)

(73) Assignee: DENSO CORPORATION, Kariya (JP)

( * ) Notice: Subject to any disclaimer, the term of this patent is extended or adjusted under 35 U.S.C. 154(b) by 168 days.

(21) Appl. No.: 14/608,768

(22) Filed: Jan. 29, 2015

(65) Prior Publication Data

US 2015/0211402 A1 Jul. 30, 2015

(30) Foreign Application Priority Data

Jan. 30, 2014 (JP) ..... 2014-15934

(51) Int. Cl.
*F01N 3/00* (2006.01)
*F01N 3/20* (2006.01)

(52) U.S. Cl.
CPC ..... *F01N 3/208* (2013.01); *F01N 3/206* (2013.01); *F01N 2240/30* (2013.01); *F01N 2240/38* (2013.01); *F01N 2610/03* (2013.01); *F01N 2610/08* (2013.01); *F01N 2900/1602* (2013.01); *F01N 2900/1806* (2013.01); *F01N 2900/1811* (2013.01)

(58) Field of Classification Search
CPC ..... F01N 3/208; F01N 3/206; F01N 2240/30
USPC ..... 60/286
See application file for complete search history.

(56) References Cited

U.S. PATENT DOCUMENTS 7,093,429 B1 * 8/2006 Cho ..... B01D 53/323 60/275
2010/0126143 A1 * 5/2010 Cho ..... B01D 53/90 60/286
2014/0260208 A1 9/2014 Sato et al.

FOREIGN PATENT DOCUMENTS

| | | |
|---|---|---|
| JP | 2000-54833 | 2/2000 |
| JP | 2005-090462 | 4/2005 |
| JP | 2005-127257 | 5/2005 |
| JP | 2006-194183 | 7/2006 |
| JP | 2009-162173 | 7/2009 |
| JP | 2011-149388 | 8/2011 |

OTHER PUBLICATIONS

English translation of Japanese Patent Application Publication No. JP 201-149388 A (Aug. 4, 2011).*

(Continued)

*Primary Examiner* — Jason Shanske
(74) *Attorney, Agent, or Firm* — Nixon & Vanderhye P.C.

(57) ABSTRACT

A reducing agent supplying device includes a reforming device, an obtaining section and a controller. The reforming device mixes fuel, which is a hydrocarbon compound, with air, and reforms the fuel by partially oxidizing the fuel with oxygen in the air. A reformed fuel is supplied into the exhaust passage as the reducing agent. The obtaining section obtains a physical quantity as a property index. The physical quantity has a correlation with property of the fuel that is supplied to the reforming device. The controller controls the reforming device according to the property index obtained by the obtaining section.

19 Claims, 13 Drawing Sheets

(56) References Cited

OTHER PUBLICATIONS

Office Action (3 pages) dated Mar. 1, 2016, issued in corresponding Japanese Application No. 2014-015934 and English translation (3 pages).
2004 "Diesel Exhaust Emission Control II—Nox After Treatment Technology", JSAE Annual Congress, Society of Automotive Engineers of Japan, Inc., May 20, 2004, 12 pages.

* cited by examiner

REDUCING AGENT SUPPLYING DEVICE

CROSS REFERENCE TO RELATED APPLICATION

This application is based on and incorporates herein by reference Japanese Patent Application No. 2014-15934 filed on Jan. 30, 2014.

TECHNICAL FIELD

The present disclosure relates to a reducing agent supplying device for supplying a hydrocarbon compound (fuel) as a reducing agent used for NOx reduction.

BACKGROUND

Generally, NOx (Nitrogen Oxides) contained in exhaust gas of an internal combustion engine is purified in reaction of the NOx with a reducing agent in the presence of a reducing catalyst. For example, a Patent Literature (JP 2009-162173 A) discloses a purifying system that uses fuel (hydrocarbon compound) for combustion of an internal combustion engine as a reducing agent, and the system supplies the fuel into an exhaust passage at a position upstream of a reducing catalyst.

SUMMARY

The inventors of the present disclosure have studied a purifying system in which fuel mixed with air is partially oxidized with oxygen in the air to reform the fuel, and the reformed fuel is supplied into an exhaust passage as the reducing agent. According to the configuration, a reducing performance of the reducing agent is improved, whereby an NOx purification rate can be increased.

However, various components different in molecular structure are mixed in a hydrocarbon-based fuel (for example, light oil) on the market, and a mixture ratio of those components is different for each of oil producing areas or sales areas. Therefore, property of fuel on the market is diverse, and when fuel is partially oxidized to be reformed, the reducing performance of the reformed fuel is significantly affected by the difference in the property of the fuel before being reformed.

It is an objective of the present disclosure to provide a reducing agent supplying device that suppresses a decrease in an NOx purification rate due to the fuel property.

In an aspect of the present disclosure, a reducing agent supplying device is for a fuel combustion system that includes a NOx purifying device with a reducing catalyst arranged in an exhaust passage to purify NOx contained in exhaust gas of an internal combustion engine. The reducing agent supplying device supplies a reducing agent into the exhaust passage at a position upstream of the reducing catalyst.

The reducing agent supplying device includes a reforming device, an obtaining section and a controller. The reforming device mixes fuel, which is a hydrocarbon compound, with air into a mixture and reforms the fuel by partially oxidizing the fuel with oxygen in the air. A reformed fuel is supplied into the exhaust passage as the reducing agent. The obtaining section obtains a physical quantity as a property index. The physical quantity has a correlation with property of the fuel that is supplied to the reforming device. The controller controls the reforming device according to the property index obtained by the obtaining section.

According to the aspect of the present disclosure, the physical quantity correlated with the property of fuel that is supplied to the reforming device is acquired as a property index, and the operation of the reforming device is controlled according to the acquired property index. For that reason, for example, when fuel has the property that the reducing performance of the fuel after being reformed is not sufficient, the reforming device is controlled to improve the reducing performance by increasing a supply amount of the reducing agent or improving the reforming action by the reforming device. Hence, a decrease in the NOx purification rate due to the fuel property can be suppressed.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
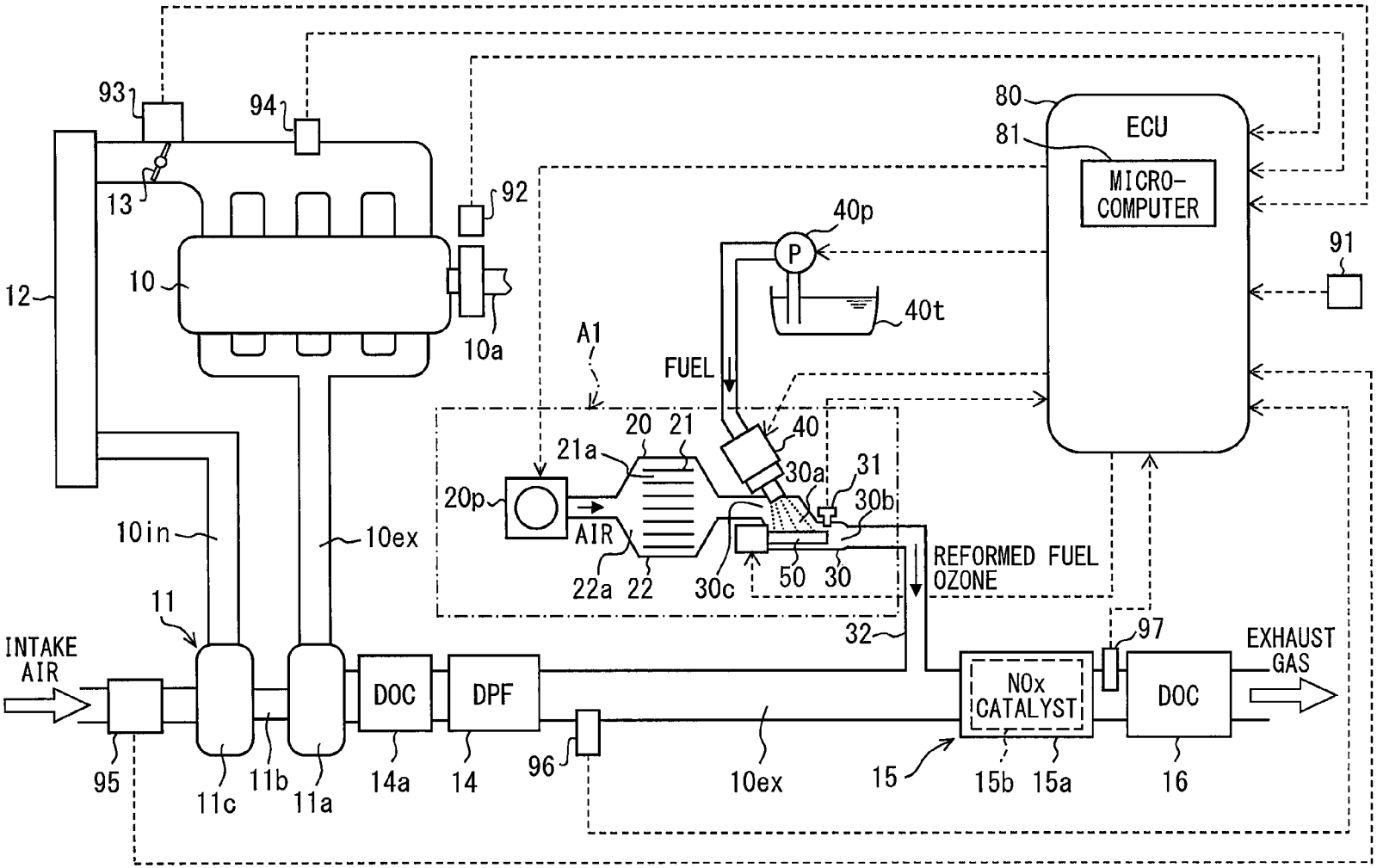
FIG. 1 is a schematic view of a reducing agent supplying device applied to a combustion system.

A plurality of embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A combustion system as illustrated in FIG. 1 includes an internal combustion engine 10, a supercharger 11, a diesel particular filter (DPF) 14, a DPF regeneration device (regenerating DOC 14*a*), a NOx purifying device 15, a reducing agent purifying device (purifying DOC 16) and an reducing agent supplying device. The combustion system is mounted on a vehicle and the vehicle is powered by an output from the internal combustion engine 10. In the present embodiment, the internal combustion engine 10 is a compression self-ignition diesel engine using diesel fuel (light oil) for combustion.

The supercharger 11 includes a turbine 11*a*, a rotating shaft 11*b* and a compressor 11*c*. The turbine 11*a* is disposed in an exhaust passage 10*ex* for the internal combustion engine 10 and rotates by kinetic energy of exhaust gas. The rotating shaft 11*b* connects an impeller of the turbine 11*a* to an impeller of the compressor 11*c* and transmits a rotating force of the turbine 11*a* to the compressor 11*c*. The compressor 11*c* is disposed in an intake passage 10*in* of the internal combustion engine 10 and supplies intake air to the internal combustion engine 10 after compressing (i.e., supercharging) the intake air.

A cooler 12 is disposed in the intake passage 10*in* downstream of the compressor 11*c*. The cooler 12 cools intake air compressed by the compressor 11*c*, and the compressed intake air cooled by the cooler 12 is distributed into plural combustion chambers of the internal combustion engine 10 through an intake manifold after a flow amount of the compressed intake air is adjusted by a throttle valve 13.

The regenerating DOC 14*a* (Diesel Oxidation Catalyst), the DPF 14 (Diesel Particulate Filter), the NOx purifying device 15, and the purifying DOC 16 are disposed in this order in the exhaust passage 10*ex* downstream of the turbine 11*a*. The DPF 14 collects particulates contained in exhaust gas. The regenerating DOC 14*a* includes a catalyst that oxidizes unburned fuel contained in the exhaust gas and that burns the unburned fuel. By burning the unburned fuel, the particulates collected by the DPF 14 are burned and the DPF 14 is regenerated, whereby the collecting capacity of the DPF 14 is maintained. It should be noted that this burning by the unburned fuel inside the regenerating DOC 14*a* is not constantly executed but is temporarily executed when the regeneration of the DPF 14 is required.

A supply passage 32 of the reducing agent supplying device is connected to the exhaust passage 10*ex* downstream of the DPF 14 and upstream of the NOx purifying device 15. A reformed fuel generated by the reducing agent supplying device is supplied as a reducing agent into the exhaust passage 10*ex* through the supply passage 32. The reformed fuel is generated by partially oxidizing hydrocarbon (i.e., fuel), which is used as a reducing agent, into partially oxidized hydrocarbon, such as aldehyde, as will be described later with reference to FIG. 7.

The NOx purifying device 15 includes a honeycomb carrier 15*b* for carrying a reducing catalyst and a housing 15*a* housing the carrier 15*b* therein. The NOx purifying device 15 purifies NOx contained in exhaust gas through a reaction of NOx with the reformed fuel in the presence of the reducing catalyst, i.e., a reduction process of NOx into $N_2$. It should be noted that, although $O_2$ is also contained in the exhaust gas in addition to NOx, the reformed reducing agent selectively (preferentially) reacts with NOx in the presence of $O_2$.

In the present embodiment, the reducing catalyst has adsorptivity to adsorb NOx. More specifically, the reducing catalyst demonstrates the adsorptivity to adsorb NOx in the exhaust gas when a catalyst temperature is lower than an activation temperature at which reducing reaction by the reducing catalyst can occur. Whereas, when the catalyst temperature is higher than the activation temperature, NOx adsorbed by the reducing catalyst is reduced by the reformed reducing agent and then is released from the reducing catalyst. For example, the NOx purifying device 15 may provide NOx adsorption performance with a silver/alumina catalyst that is carried by the carrier 15*b*.

The purifying DOC 16 has a housing that houses a carrier carrying an oxidation catalyst. The purifying DOC 16 oxidizes the reducing agent, which flows out from the NOx purifying device 15 without being used for NOx reduction, in the presence of the oxidation catalyst. Thus, the reducing agent can be prohibited from releasing into an atmosphere through an outlet of the exhaust passage 10*ex*. It should be noted that an activation temperature of the oxidation catalyst (e.g., 200° C.) is lower than the activation temperature (e.g., 250° C.) of the reducing catalyst.

Next, the reducing agent supplying device will be described below. Generally, the reducing agent supplying device generates the reformed fuel and supplies the reformed fuel into the exhaust passage 10*ex* through the supply passage 32. The reducing agent supplying device includes a reforming device A1 and an electric control unit (ECU 80), as will be described below. The reforming device A1 includes a discharging reactor 20 (ozone generator), an air pump 20*p*, a reaction container 30, a fuel injector 40 and a heater 50.

The discharging reactor 20 includes a housing 22 having a fluid passage 22*a* therein and a plurality of pairs of electrodes 21 are arranged inside the fluid passage 22*a*. More specifically, the electrodes 21 are held within the housing 22 through electric insulating members. The electrodes 21 have a plate shape and are arranged to face each other in parallel. One electrode 21, which is grounded, and the other electrode 21, which is applied with high voltage when electric power is supplied to the discharging reactor 20, are alternately arranged. Power application to the electrodes 21 is controlled by a microcomputer 81 of the ECU 80.

Air that is blown by the air pump 20*p* flows into the housing 22 of the discharging reactor 20. The air pump 20*p* is driven by an electric motor, and the electric motor is controlled by the microcomputer 81. The air blown by the air pump 20*p* flows into the fluid passage 22*a* within the housing 22, and flows through discharging passages 21*a* formed between the electrodes 21.

The reaction container 30 is attached to a downstream side of the discharging reactor 20, and a reaction chamber 30*a* is formed inside the reaction container 30. In the reaction chamber 30*a*, fuel is mixed with air into a mixture and the fuel is oxidized with oxygen in the air. Air that passed through the discharging passages 21*a* flows into the reaction chamber 30*a* through an air inlet 30*c*, and thereafter spouts from an injection port 30*b* formed in the reaction container 30. The injection port 30*b* is in communication with the supply passage 32.

The fuel injector 40 is attached to the reaction container 30. Fuel in liquid form (liquid fuel) within a fuel tank 40*t* is supplied to the fuel injector 40 by a pump 40*p*, and injected into the reaction chamber 30*a* through injection holes (not shown) of the fuel injector 40. The fuel within the fuel tank 40*t* is also used for combustion as described above, and thus the fuel is commonly used for combustion of the internal combustion engine 10 and used as the reducing agent. The fuel injector 40 has an injection valve and the valve is actuated by an electromagnetic force by an electromagnetic solenoid. The microcomputer 81 controls electric power supply to the electromagnetic solenoid.

The heater 50 is attached to the reaction container 30, and the heater 50 has a heating element (not shown) that generates heat when electric power is supplied to the heating element. The electric power supply to the heating element is controlled by the microcomputer 81. A heat generating surface of the heater 50 is positioned inside the reaction chamber 30*a*, and heats liquid fuel injected from the fuel injector 40. The liquid fuel heated by the heater 50 is vaporized within the reaction chamber 30*a*. The vaporized fuel is further heated to a given temperate or higher by the heater 50. As a result, the fuel is thermally decomposed into hydrocarbon that has a small carbon number, i.e., cracking occurs.

The fuel injector 40 is located above the heat generating surface of the heater 50, and the liquid fuel is injected from the fuel injector 40 onto the heat generating surface. The liquid fuel that adheres to the heat generating surface is vaporized.

A temperature sensor 31 that detects a temperature inside the reaction chamber 30*a* is attached to the reaction container 30. Specifically, the temperature sensor 31 is arranged above the heat generating surface of the heater 50 within the reaction chamber 30*a*. A temperature detected by the temperature sensor 31 is a temperature of the vaporized fuel after reacting with air. The temperature sensor 31 outputs information (detected temperature) on the detected temperature to the ECU 80.

When the electric power is supplied to the discharging reactor 20, electrons emitted from the electrodes 21 collide with oxygen molecules contained in air in the discharging passages 21*a*. As a result, ozone is generated from the oxygen molecules. That is, the discharging reactor 20 brings the oxygen molecules into a plasma state through a discharging process, and generates ozone as active oxygen. Then, the ozone generated by the discharging reactor 20 is contained in air that flows into the reaction chamber 30*a*.

A cool flame reaction is generated in the reaction chamber 30*a*. In the cool flame reaction, fuel in gas form is partially oxidized with oxygen or ozone within air. The fuel partially oxidized is called "reformed fuel", and partial oxide (for example, aldehyde) may be one of examples of the reformed fuel in which a portion of the fuel (hydrocarbon compound) is oxidized with an aldehyde group (CHO).

It should be noted that fuel under a high temperature environment burns by self-ignition by oxidation reaction with oxygen contained in air, even in the atmospheric pressure. Such an oxidation reaction by the self-ignition combustion is also called "hot flame reaction" in which carbon dioxide and water are generated while generating heat. However, when a ratio (equivalent ratio) of the fuel and the air, and the ambient temperature fall within given ranges, a period for which an oxidation reaction stays in the cool flame reaction becomes longer as described below, and thereafter the hot flame reaction occurs. That is, the oxidation reaction occurs in two steps, the cool flame reaction and the hot flame reaction (refer to FIGS. 2 and 3).

The cool flame reaction is likely to occur when the ambient temperature is low, and the equivalent ratio is low. In the cool flame reaction, fuel is partially oxidized with oxygen contained in the ambient air. When the ambient temperature rises due to heat generation caused by the cool flame reaction, and thereafter a given time elapses, the fuel that is partially oxidized (for example, aldehyde) is oxidized, whereby the hot flame reaction occurs. When the partially oxidized fuel, such as aldehyde, generated through the cool flame reaction is used as an NOx purification reducing agent, an NOx purification rate is improved as compared with a case in which the fuel not partially oxidized is used.

Figure 2:
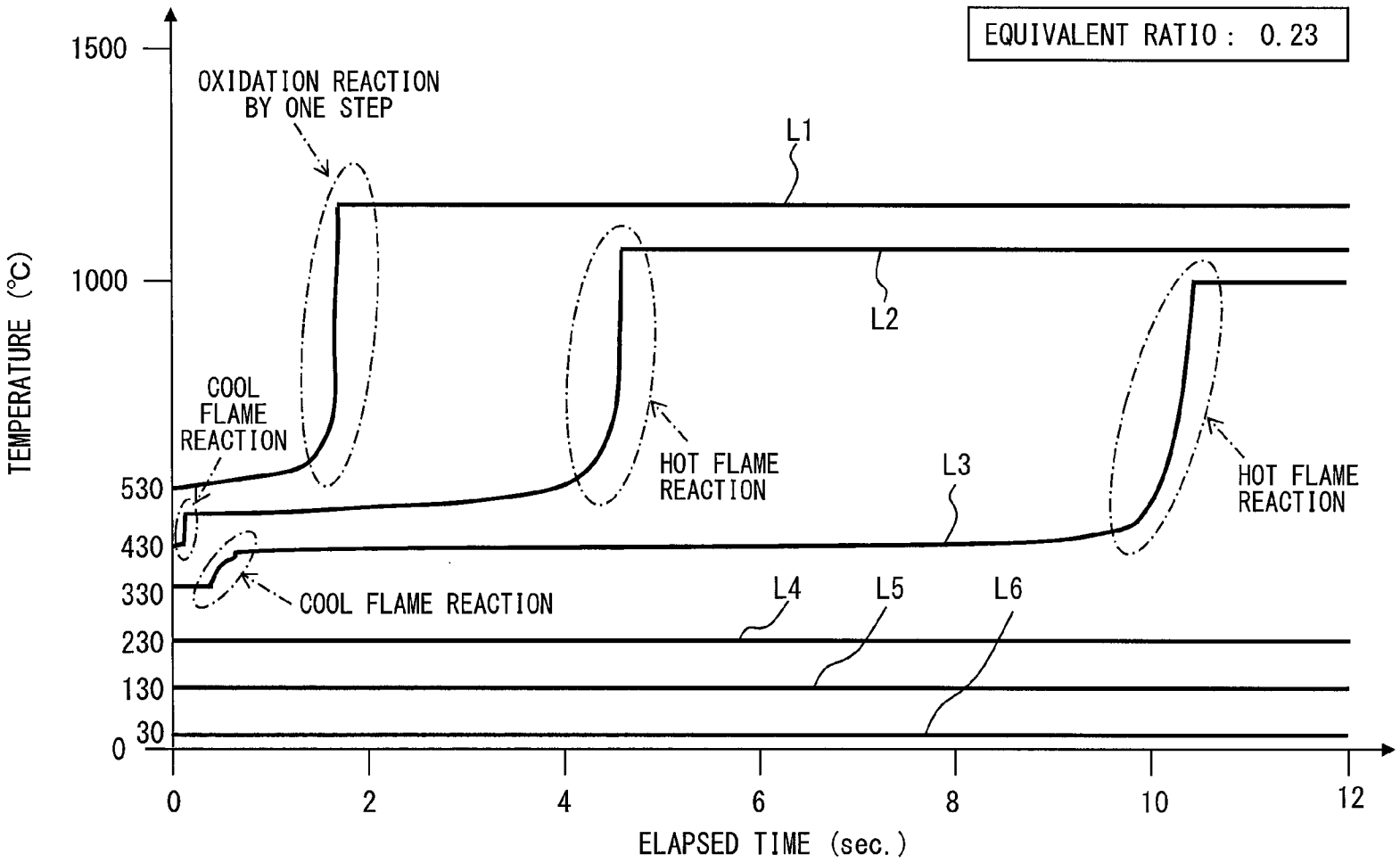
FIG. 2 is a graph illustrating results of simulating temperature changes caused by two-step oxidation reaction under different conditions of an initial temperature.
Figure 3:
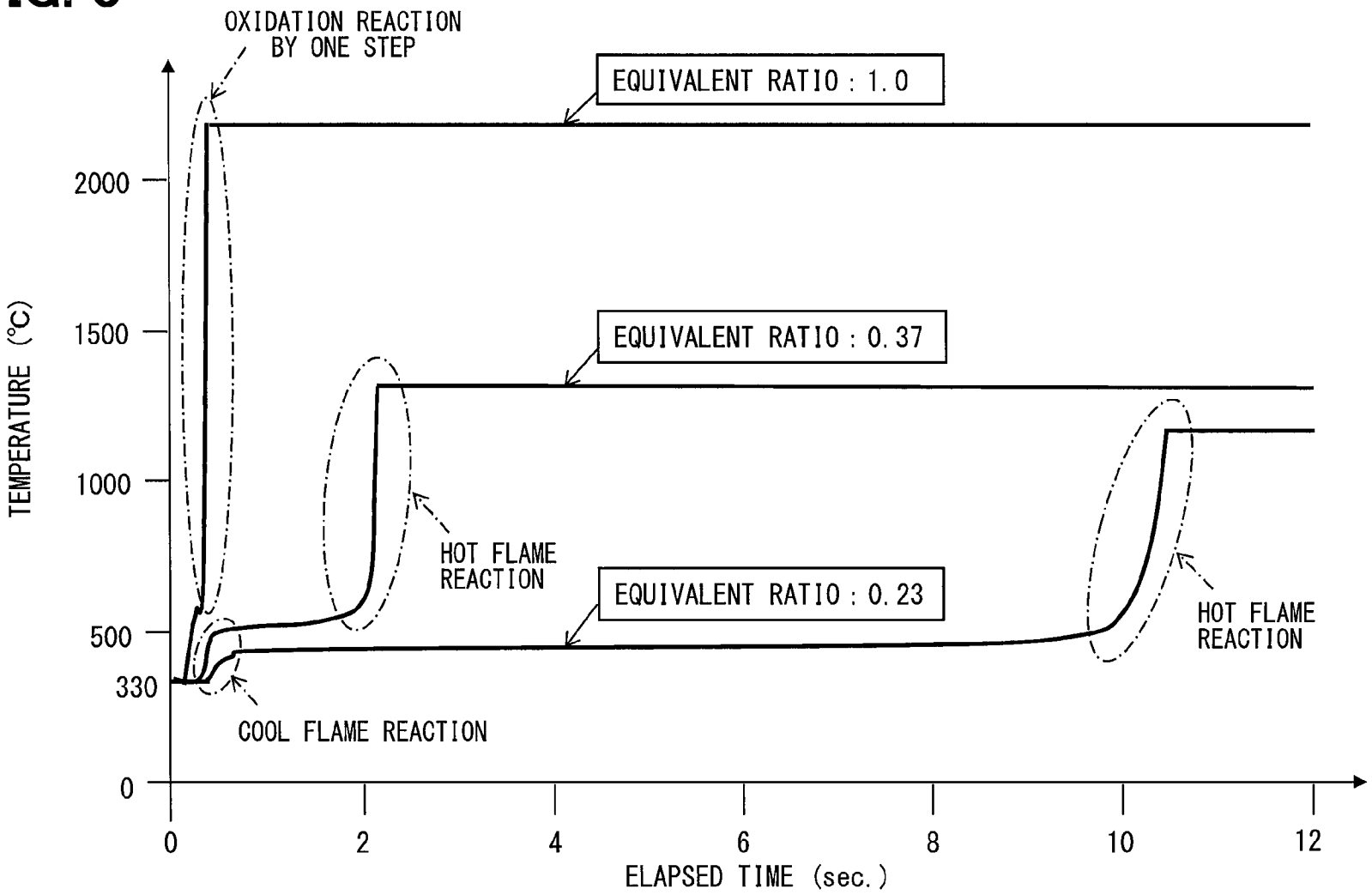
FIG. 3 is a graph illustrating results of simulating temperature changes caused by two-step oxidation reaction under different conditions of an equivalence ratio.

FIGS. 2 and 3 illustrate simulation results showing a change in a temperature (ambient temperature) of the reaction chamber 30*a* with respect to an elapsed time from a spray start in a case where fuel (hexadecane) is sprayed onto the heater 50 having a temperature of 430° C. Also, FIG. 2 illustrates the simulation at the respective temperatures of the heater 50. In FIG. 2, symbols L1, L2, L3, L4, L5, and L6 show results when the heater temperature is set to 530° C., 430° C., 330° C., 230° C., 130° C., and 30° C., respectively.

As indicated by the symbol L1, when the heater temperature is 530° C., there is almost no period to stay in the cool flame reaction, and the oxidation reaction is completed with only one step. On the contrary, when the heater temperature is set to 330° C. or 430° C. as indicated by the symbols L2 and L3, the two-step oxidation reaction occurs. Also, when the heater temperature is set to 330° C., a start timing of the cool flame reaction is delayed as compared with a case where the heater temperature is set to 430° C., as indicated by the symbols L2 and L3. Also, when the heater temperature is set to 230° C. or lower, as indicated by the symbols L4 to L6, none of the cool flame reaction and the hot flame reaction occurs, i.e., the oxidation reaction does not occur.

In the simulation illustrated in FIG. 2, the equivalent ratio, which is a weight ratio of injected fuel to supplied air, is set to 0.23. In this connection, the present inventors have obtained results illustrated in FIG. 3 with the simulation of the different equivalent ratios. It should be noted that the equivalent ratio may be defined as a value by dividing "weight of fuel contained in an air-fuel mixture" by "weight of fuel that can be completely burned". As illustrated in FIG. 3, when the equivalent ratio is set to 1.0, there is almost no period to stay in the cool flame reaction, and the oxidation reaction is completed with one step. Also, when the equivalent ratio is set to 0.37, the start timing of the cool flame reaction is advanced, a cool flame reaction rate increases, a cool flame reaction period decreases, and the ambient temperature at the time of completing the cool flame reaction increases, as compared with a case in which the equivalent ratio is set to 0.23.

The following findings may be obtained from the results in FIGS. 2 and 3. That is, when the ambient temperature is lower than a lower limit value, no oxidation reaction occurs.

When the ambient temperature is higher than the lower limit value but the equivalent ratio is equal to or higher than 1.0, a one-step oxidation reaction region in which the oxidation reaction is completed with only one step is formed. When the ambient temperature falls within a given temperature range, and the equivalent ratio falls within a given equivalent ratio range, a two-step oxidation reaction occurs.

When the ambient temperature is adjusted to an optimal temperature (for example, 370° C.) within the given temperature range, the equivalent ratio that enables the two-step oxidation reaction becomes a maximum value (for example, 1.0). Therefore, in order to early generate the cool flame reaction, the heater temperature may be adjusted to the optimal temperature, and the equivalent ratio may be set to 1.0. However, since the cool flame reaction does not occur when the equivalent ratio exceeds 1.0, it is desirable to adjust the equivalent ratio to a value smaller than 1.0 by a margin. In the simulation illustrated in FIGS. 2 and 3, an ozone concentration in air is set to zero, and the start timing of the cool flame reaction becomes earlier as the ozone concentration increases.

The microcomputer 81 of the ECU 80 includes a memory unit to store programs, and a central processing unit executing an arithmetic processing according to the programs stored in the memory unit. The ECU 80 controls the operation of the internal combustion engine 10 based on detection values of sensors. The sensors may include an accelerator pedal sensor 91, an engine speed sensor 92, a throttle opening sensor 93, an intake air pressure sensor 94, an intake amount sensor 95, an exhaust temperature sensor 96, or the like.

The accelerator pedal sensor 91 detects a depressing amount of an accelerator pedal of a vehicle by a driver. The engine speed sensor 92 detects a rotational speed of an output shaft 10*a* of the internal combustion engine 10 (i.e., an engine rotational speed). The throttle opening sensor 93 detects an opening amount of the throttle valve 13. The intake air pressure sensor 94 detects a pressure of the intake passage 10*in* at a position downstream of the throttle valve 13. The intake amount sensor 95 detects a mass flow rate of intake air.

Figure 4:
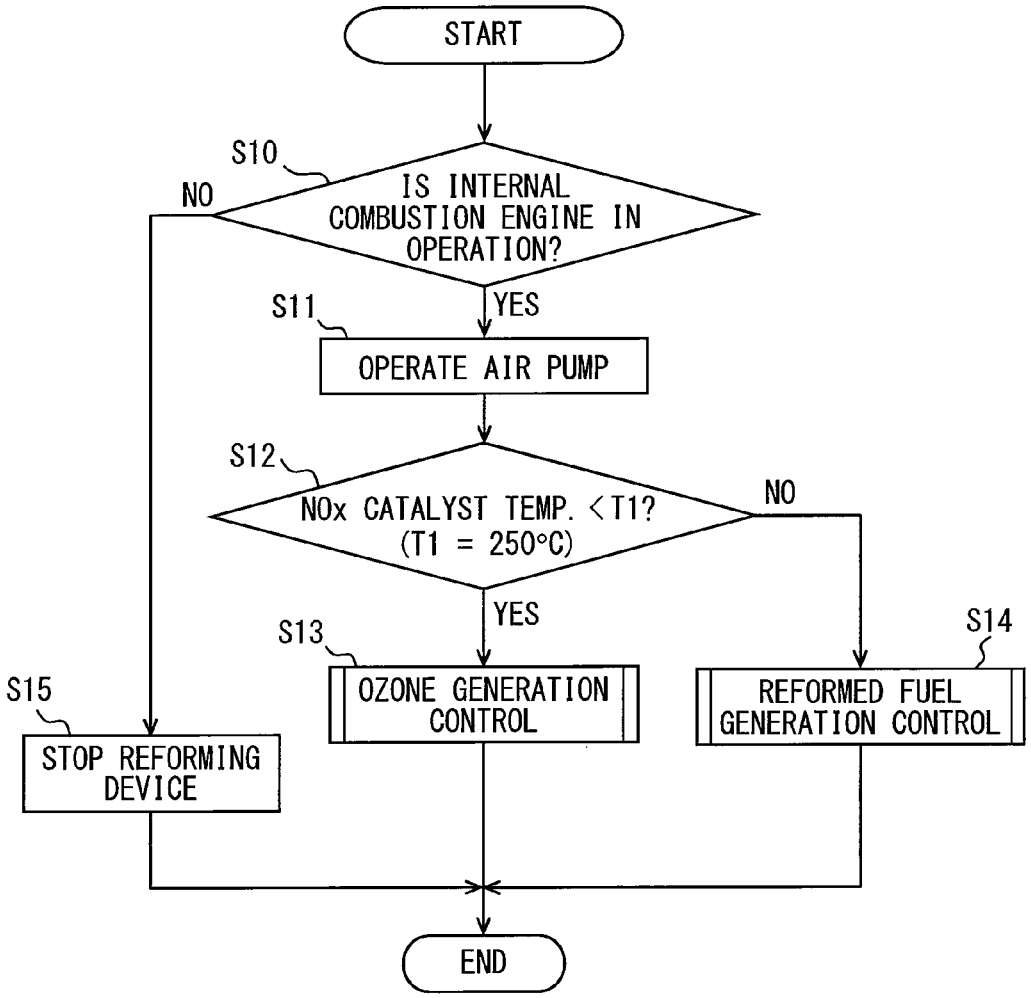
FIG. 4 is a flowchart illustrating a process to switch between generation of ozone and generation of reformed fuel according to the reducing agent supplying device illustrated in FIG. 1.

The ECU 80 generally controls an amount and injection timing of fuel for combustion that is injected from a fuel injection valve (not shown) according to a rotational speed of the output shaft 10*a* and an engine load of the internal combustion engine 10. Further, the ECU 80 controls the operation of the reforming device A1 based on an exhaust temperature detected by the exhaust temperature sensor 96. In other words, the microcomputer 81 switches between the generation of the reformed fuel and the generation of the ozone by repeatedly executing a process (i.e., a program) as shown in FIG. 4 at a predetermined period. The process starts when an ignition switch is turned on and is constantly executed while the internal combustion engine 10 is running.

At Step 10 of FIG. 4, the microcomputer 81 determines whether the internal combustion engine 10 is running. When the internal combustion engine 10 is not running, the operation of the reducing agent supplying device (reforming device) is stopped at Step 15. More specifically, when electric power is supplied to the discharging reactor 20, the air pump 20*p*, the fuel injector 40 and the heater 50, the electric power supply is stopped. Whereas, when the internal combustion engine 10 is running, the reducing agent supplying device is operated according to a temperature of the reducing catalyst (NOx catalyst temperature) inside the NOx purifying device 15.

More specifically, at Step 11, the air pump 20*p* is operated with a predetermined power amount. Next, at Step 12, it is determined whether the NOx catalyst temperature is lower than an activation temperature T1 of the reducing catalyst (e.g., 250° C.). The NOx catalyst temperature is estimated using an exhaust temperature detected by the exhaust temperature sensor 96. It should be noted that the activation temperature of the reducing catalyst is a temperature at which the reformed fuel can purify NOx through the reduction process.

When it is determined that the NOx catalyst temperature is lower than the activation temperature T1, a subroutine process for an ozone generation control is executed (Step 13). Initially, a predetermined power amount is supplied to the electrodes 21 of the discharging reactor 20 to start electrically discharging. Next, electric power supply to the heater 50 is stopped, and electric supply to the fuel injector 40 is stopped.

According to the ozone generation control, the discharging reactor 20 generates ozone and the generated ozone is supplied into the exhaust passage 10*ex* through the reaction chamber 30*a* and the supply passage 32. In this case, if power supply to the heater 50 is implemented, the ozone would be heated by the heater 50 and collapse. Also, if fuel is supplied, the ozone inside the discharging reactor 20 would react with the supplied fuel. In view of this, in the above-mentioned ozone generation control, heating by the heater 50 and the fuel supply are stopped. For that reason, since the reaction of the ozone with the fuel, and the heating collapse can be avoided, the generated ozone is supplied into the exhaust passage 10*ex* as it is.

Figure 14:
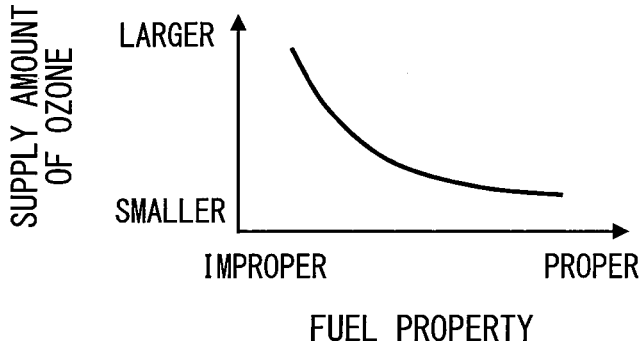
FIG. 14 is a map illustrating an ozone supply amount suitable for the fuel property.

When it is determined that the NOx catalyst temperature is equal to or higher than the activation temperature T1 in FIG. 4, a subroutine process of reformed fuel generation control illustrated in FIG. 14 is executed at Step 14.

An outline of the process in FIG. 5 will be described according to dashed lines in the figure. In Step 30, the operation of the heater 50 is controlled to adjust a temperature inside the reaction container 30 within a given temperature range. Then, in Step 40, the operation of the fuel injector 40 is controlled to inject fuel corresponding to an amount of the reducing agent that is required at the NOx purifying device 15. Next, in Step 50, the operation of the air pump 20*p* is controlled to adjust the equivalent ratio, which is the ratio of fuel to be supplied into the reaction container 30 to air, within a given equivalent ratio range. The temperature range and the equivalent ratio range are the ranges in the above-mentioned two-step oxidation reaction regions. Therefore, the cool flame reaction occurs, and thus the reformed fuel is generated.

Further, in Step 60, the power supply to the discharging reactor 20 is controlled according to a concentration of fuel within the reaction container 30. Accordingly, ozone is generated, and the generated ozone is supplied into the reaction container 30. Thus, the start timing of the cool flame reaction is advanced, and the cool flame reaction time is reduced. Hence, even when the reaction container 30 is downsized so that a staying time of fuel within the reaction container 30 is decreased, the cool flame reaction can be completed within the staying time, whereby the reaction container 30 can be downsized.

The microcomputer 81 executing Step 30 may provide "temperature controller (controller)". The microcomputer 81 executing Step 40 may provide "fuel injection amount controller (controller)". The microcomputer 81 executing Step 50 may provide "equivalent ratio controller (controller)". The microcomputer 81 executing Step 60 may provide "discharging power controller (controller)".

Hereinafter, the details of those steps S30, S40, S50, and S60 will be described with reference to FIG. 5.

First, a description will be given of the process of Step 30 by the temperature controller. In Step 31, a temperature in the reducing agent supplying device, that is, a temperature within the reaction container 30 is obtained. Specifically, a detection temperature Tact detected by the temperature sensor 31 is obtained. In subsequent Step 32, an amount of heating by the heater 50 is adjusted so that the detection temperature Tact matches a target temperature Ttrg based on a difference ΔT between the target temperature Ttrg that is predetermined and the detection temperature Tact.

Specifically, a power supply duty ratio to the heater 50 is adjusted according to the difference ΔT. The target temperature Ttrg used in Step 32 is set to an ambient temperature (for example, 370° C.) at which the equivalent ratio becomes maximum in the above two-step oxidation reaction region. Since a temperature of the reaction chamber 30*a* rises during the cool flame reaction, a temperature of the heater 50 per se is controlled to be a value lower than the target temperature Ttrg by a temperature rising amount during the cool flame reaction.

Subsequently, a description will be given of the process of Step 40 by the fuel injection amount controller. In Step 41, a value for supplying fuel, which is necessary to reduce all of NOx that flows into the NOx purifying device 15, into the NOx purifying device 15 without excess or deficiency is set as a target fuel flow rate Ftrg. The target fuel flow rate Ftrg is the mass of the fuel to be supplied into the NOx purifying device 15 per unit time.

Specifically, the target fuel flow rate Ftrg is set based on an NOx inflow rate that will be described below, and the NOx catalyst temperature. The NOx inflow rate is the mass of NOx that flows into the NOx purifying device 15 per unit time. For example, the NOx inflow rate can be estimated based on an operating condition of the internal combustion engine 10. The NOx catalyst temperature is a temperature of the reducing catalyst inside the NOx purifying device 15. For example, the NOx catalyst temperature can be estimated based on a temperature detected by the exhaust temperature sensor 96.

The target fuel flow rate Ftrg increases as the NOx inflow rate increases. Also, since a reduced amount (reducing performance) of NOx in the presence of the reducing catalyst changes according to the NOx catalyst temperature, the target fuel flow rate Ftrg is set according to a difference in the reducing performance at the NOx catalyst temperature. For example, a map representing an optimum value of the target fuel flow rate Ftrg with respect to the NOx inflow rate and the NOx catalyst temperature is stored in the microcomputer 81 in advance. The target fuel flow rate Ftrg is set with reference to the map based on the NOx inflow rate and the NOx catalyst temperature.

In subsequent Step 42, the operation of the fuel injector 40 is controlled to inject fuel based on the target fuel flow rate Ftrg set at Step 41. Specifically, an opening time of the fuel injector 40 increases as the target fuel flow rate Ftrg increases, thereby increasing an injected fuel amount during one valve opening operation. The target fuel flow rate Ftrg may correspond to "target injection amount".

Subsequently, a description will be given of the process of Step 50 by the equivalent ratio controller. In Step 51, a target equivalent ratio ϕtrg that provides the cool flame reaction corresponding to the detection temperature Tact is calculated. Specifically, a maximum value ϕmax of the equivalent ratio, which corresponds to the ambient temperature and which is the maximum value of the equivalent ratio in the two-step oxidation reaction region, is stored as the target equivalent ratio ϕtrg in the microcomputer 81 in advance. For example, a map of a value of the target equivalent ratio ϕtrg corresponding to the ambient temperature is prepared and the map is stored in advance. Then, the target equivalent ratio ϕtrg corresponding to the detection temperature Tact is calculated with reference to the map.

In subsequent Step 52, a target air flow rate Atrg is calculated based on the target equivalent ratio ϕtrg set at Step 51, and the target fuel flow rate Ftrg set at Step 42. Specifically, the target air flow rate Atrg is so calculated as to meet ϕtrg=Ftrg/Atrg. In subsequent Step 53, the operation of the air pump 20*p* is controlled based on the target air flow rate Atrg calculated at Step 52. Specifically, the energization duty ratio to the air pump 20*p* increases as the target air flow rate Atrg increases.

Then, a description will be given of the process of Step 60 by the discharging power controller. Initially, a target ozone flow rate Otrg is calculated at Step 61 based on the target fuel flow rate Ftrg set at Step 41. Specifically, the target ozone flow rate Otrg is calculated so that a ratio of an ozone concentration to a fuel concentration inside the reaction chamber 30*a* becomes a given value (for example, 0.2). For example, the ratio is set so that the cool flame reaction can be completed within a given time (for example, 0.02 sec).

In subsequent Step 62, a target energization amount Ptrg to the discharging reactor 20 is calculated based on the target air flow rate Atrg calculated at Step 52 and the target ozone flow rate Otrg calculated at Step S61. That is, an energizing power to the discharging reactor 20 is controlled according to the target energization amount Ptrg to adjust a generation amount of ozone to a target generation amount.

Specifically, since the staying time of air in the discharging passages 21*a* decreases as the target air flow rate Atrg increases, the target energization amount Ptrg is controlled to be increased. Also, the target energization amount Ptrg increases as the target ozone flow rate Otrg increases. In subsequent Step 63, the energization amount to the discharging reactor 20 is controlled based on the target energization amount Ptrg calculated at Step 62. Specifically, the energization duty ratio to the discharging reactor 20 increases as the target energization amount Ptrg increases.

According to the process described above in FIG. 5, the microcomputer 81 controls the operation of the reforming device A1 using the target temperature Ttrg, the target fuel flow rate Ftrg, the target air flow rate Atrg, and the target energization amount Ptrg, as four control parameters. However, a difference in the property of fuel supplied to the fuel injector 40 from the fuel tank 40*t* greatly affects the reducing performance of the reformed fuel. For that reason, an optimal value of the control parameters also changes according to the fuel property. Under the circumstances, in the present embodiment, the fuel property is estimated, and the control parameters to control the reforming device A1 can change according to the estimation results of the fuel property.

Figure 6:
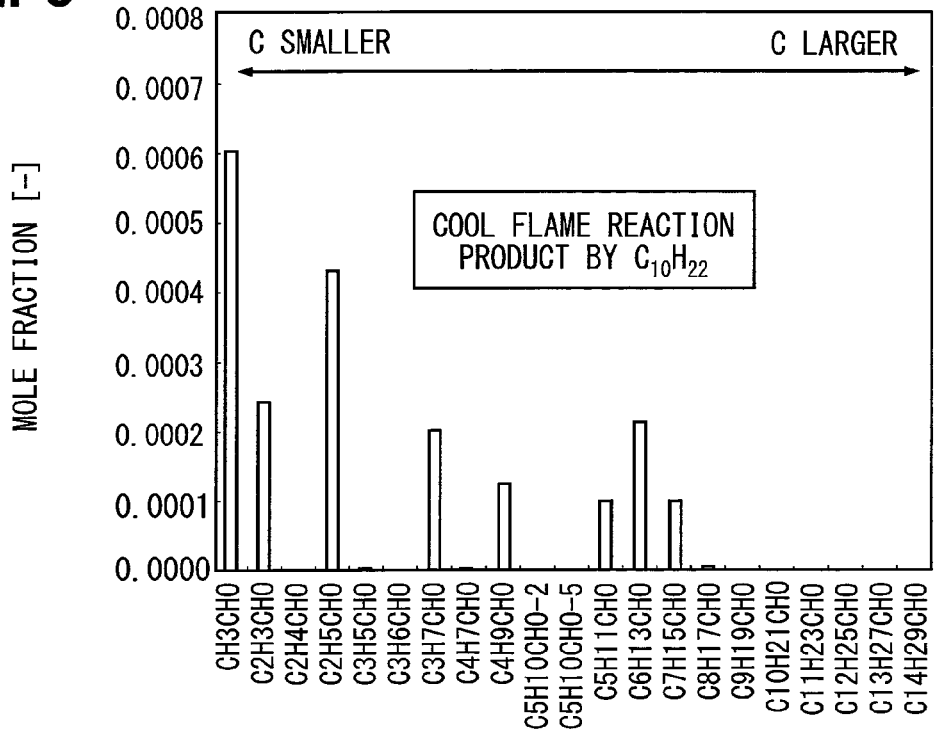
FIG. 6 is a graph illustrating simulation results of a cool flame reaction product in a case where fuel supplied to a reaction chamber is $C_{10}H_{22}$.
Figure 7:
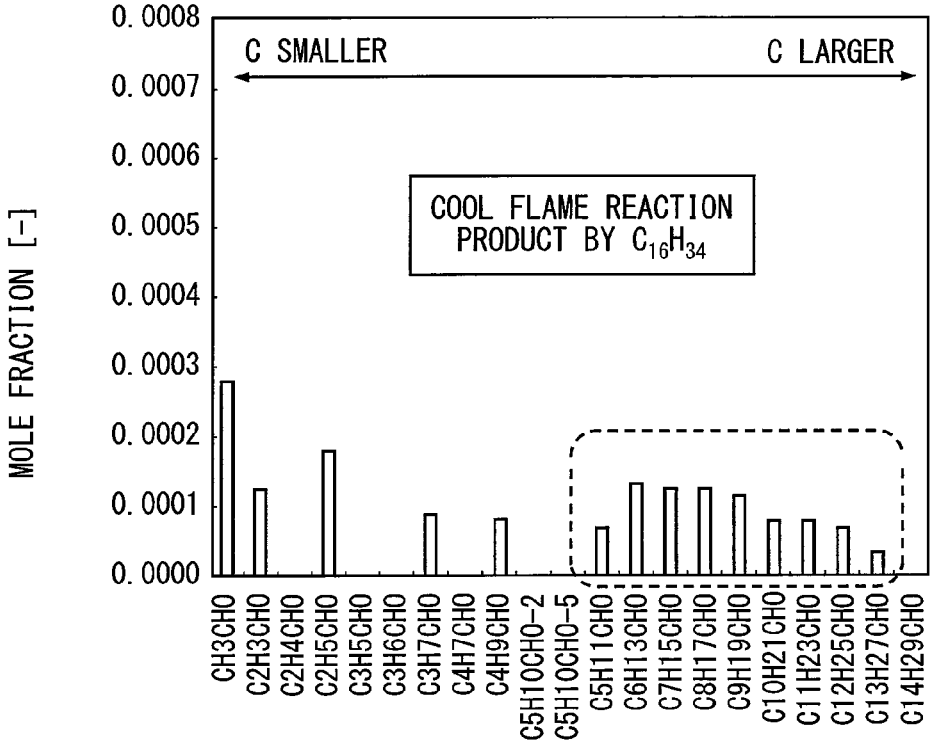
FIG. 7 is a graph illustrating simulation results of a cool flame reaction product in a case where fuel supplied to a reaction chamber is $C_{16}H_{34}$.

The axis of abscissa in FIGS. 6 and 7 represents the type of the reformed fuel generated through the cool flame reaction, and the number of carbon atoms contained in the reformed fuel increases in a right direction in the figures. The axis of ordinate in FIGS. 6 and 7 represents a mole fraction with which the respective reformed fuels are generated. As illustrated in the figure, the number of carbon atoms contained in the reformed fuel generated through the cool flame reaction becomes large, when fuel having the property with the large number of carbon atoms is supplied into the reaction chamber 30*a* (refer to dotted lines in FIG. 7). The reformed fuel with the larger number of carbon atoms has low reducing performance in the presence of the NOx catalyst.

Figure 8:
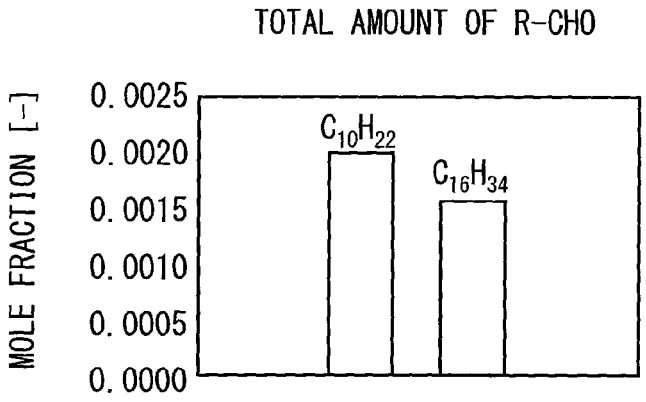
FIG. 8 is a graph illustrating simulation results showing a total amount of the cool flame reaction product illustrated in FIGS. 6 and 7.

Moreover, as illustrated in FIG. 8, the mole fraction of the reformed fuel decreases as the number of carbon atoms in the fuel increases, thus the number of moles in the reducing agent decreases. For that reason, the microcomputer 81 controls the reforming device A1 according to the process as shown in FIG. 9 to change the control parameter such that a purification rate increases as the number of carbon atoms in the fuel property increases.

Figure 9:
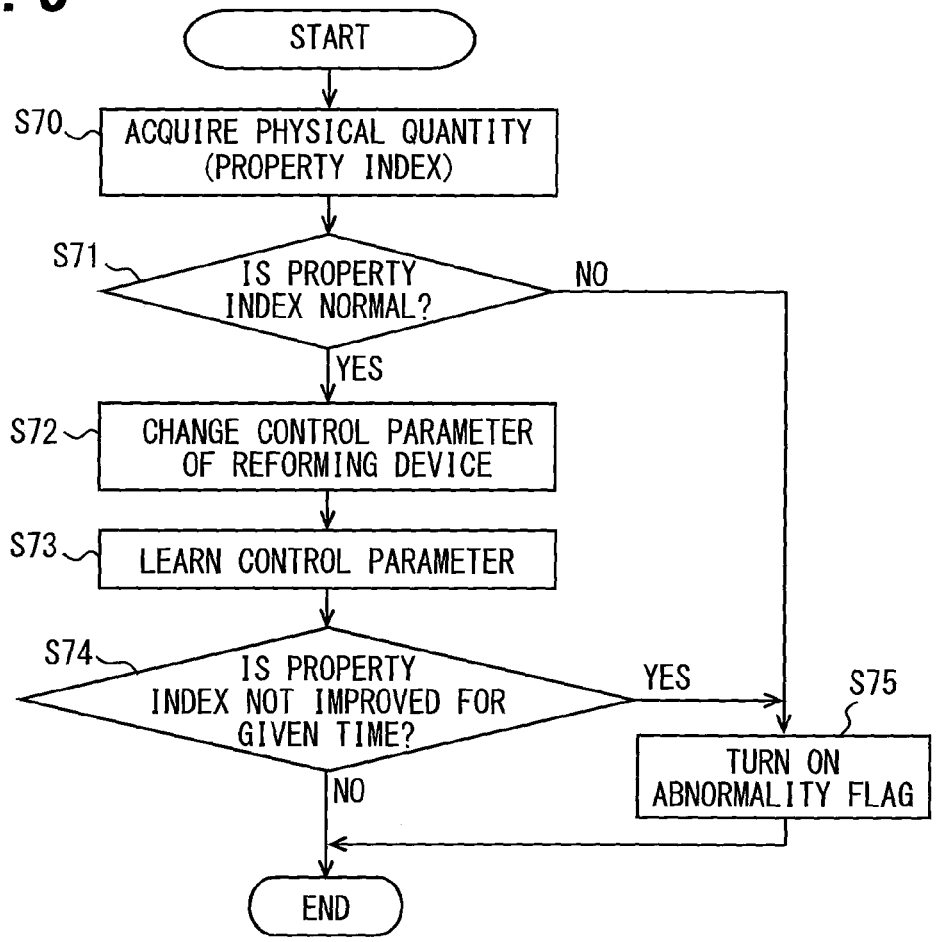
FIG. 9 is a flowchart illustrating a process for changing the operation of a reforming device according to fuel property.

That is, in Step 70 of FIG. 9, a physical quantity having a correlation with the fuel property is obtained as the property index. In the present embodiment, the NOx purification rate by the NOx purifying device 15 is obtained as a property index. The NOx purification rate is a rate of the amount of NOx reduced by the NOx purifying device 15 to the amount of NOx flowing into the NOx purifying device 15. There is such a correlation that the NOx purification rate is lowered when the fuel property is improper for the reduction.

In more detail, an NOx sensor 97 is disposed in the exhaust passage 10*ex* downstream of the NOx purifying device 15 and the NOx sensor 97 detects an NOx outflow amount that has not been reduced by the NOx purifying device 15. Further, an NOx inflow amount, which is exhausted from the internal combustion engine 10 and flows into the NOx purifying device 15, is estimated based on the operating condition of the internal combustion engine 10. Then, a rate of the NOx outflow amount to the NOx inflow amount is calculated as the NOx purification rate.

In subsequent Step 71, it is determined whether the property index (NOx purification rate) obtained at Step 70 falls within a normal range. For example, when the NOx purification rate is less than a preset lower limit value, occurring of abnormality in the NOx purifying device 15 or the reforming device A1 is estimated. Then, in Step 75, an abnormality flag is set to on, and a fact that the abnormality occurs is notified the user of.

Figure 10:
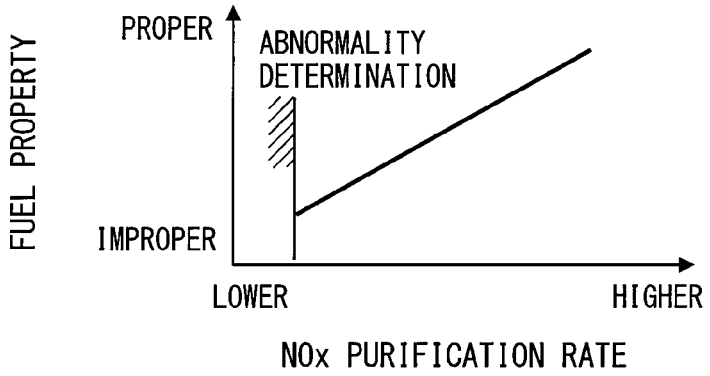
FIG. 10 is a graph illustrating a correlation between an NOx purification rate and the fuel property.

On the other hand, when the property index obtained in Step 70 falls within the normal range, the control parameter of the reforming device A1 is changed according to property index in subsequent Step 72. For example, as illustrated in FIG. 10, the fuel property is not more suitable for the reduction when the NOx purification rate is low, and the reducing performance is also low. Therefore, when the NOx purification rate is low, the control parameter is changed such that the purification rate increases. In the present embodiment, the target fuel flow rate Ftrg is changed as the control parameter.

Figure 11:
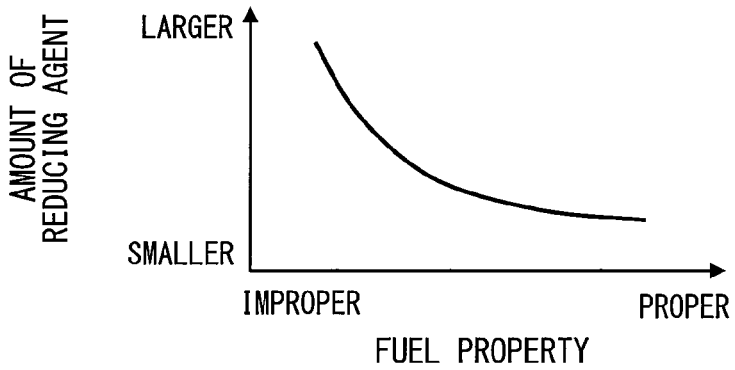
FIG. 11 is a graph illustrating a reducing agent amount suitable for the fuel property.
Figure 12:
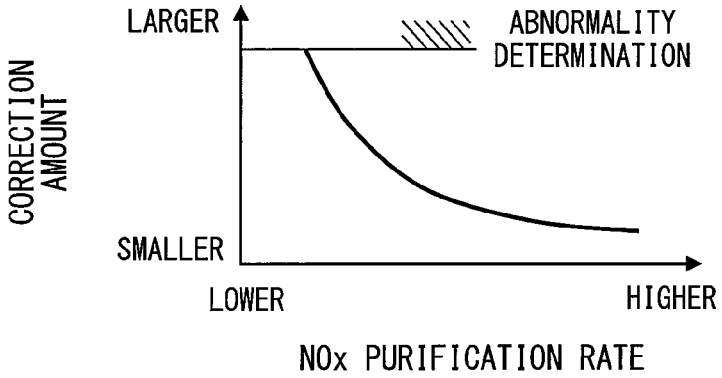
FIG. 12 is a graph illustrating a reducing agent amount suitable for the NOx purification rate.

That is, as illustrated in FIG. 11, the target fuel flow rate Ftrg is corrected such that an amount of the reducing agent increases when the fuel property is not more suitable for the reduction. Specifically, a map of a correction amount of the target fuel flow rate Ftrg (reducing agent amount) corresponding to the NOx purification rate is prepared as illustrated in FIG. 12, and the map is stored in advance. Then, the correction amount of the target fuel flow rate Ftrg corresponding to the NOx purification rate (property index) obtained at Step 70 is calculated using the map illustrated in FIG. 12, and the target fuel flow rate Ftrg is corrected with the correction amount. With the above processing, the target fuel flow rate Ftrg set in Step 41 of FIG. 5 is corrected, and the operation of the fuel injector 40 is controlled based on the corrected target fuel flow rate Ftrg at Step 42 of FIG. 5.

In Step S73 of FIG. 9, the control parameter that has been corrected at Step 72 is learned. Specifically, the map used for calculating the target fuel flow rate Ftrg at Step 41 of FIG. 5 is rewritten and updated. That is, an optimum value of the target fuel flow rate Ftrg with respect to the NOx inflow rate and the NOx catalyst temperature is rewritten to the target fuel flow rate Ftrg that is corrected at Step 72. When the internal combustion engine 10 operates next time, the fuel property will be highly likely identical with those this time. Therefore, the target fuel flow rate Ftrg is thus learned so that a fuel injection amount can be rapidly changed to the fuel injection amount that corresponds to the fuel property in a next operation.

When it is determined at Step 74 that the NOx purification rate (property index) is not improved for a given time or longer although the control parameter is corrected at Step 72, the process proceeds to the above-mentioned Step 75, and the abnormality flag is set to on.

The microcomputer 81 executing Step 70 may provide "obtaining section" that obtains the property index. The microcomputer 81 executing Step 72 may provide "property index controller (controller)" that controls the operation of the reforming device A1 according to the property index. The microcomputer 81 executing Step 71 may provide "abnormality determiner" that determines abnormality in the reforming device A1 or the NOx purifying device 15 when the property index has a value beyond a predetermined normal range.

As described above, the reducing agent supplying device according to the present embodiment obtains the NOx purification rate as the property index, and changes the control for the reforming device A1, that is, a fuel injection amount from the fuel injector 40 is changed according to the acquired NOx purification rate.

Specifically, when the fuel which has the low property index and not suitable for the reduction is supplied, the target fuel flow rate Ftrg (control parameter) is corrected to increase. For that reason, a reducing agent amount supplied into the exhaust passage 10*ex* increases, whereby a decrease in the NOx purification rate due to the fuel property can be suppressed. On the other hand, when the property index is high, the target fuel flow rate Ftrg is corrected to decrease. Hence, an excessive supply of a reducing agent amount into the exhaust passage 10*ex* is prevented. Accordingly, excessive or deficient supply of the reducing agent due to a difference in the fuel property can be suppressed.

Further, in the present embodiment, the target fuel flow rate Ftrg in the plural control parameters for the reforming device A1 is changed according to the property index. For that reason, since the supply amount of the reducing agent is controlled according to the difference in the fuel property, it can be realized with high precision to provide the supply amount of the reducing agent that corresponds to the fuel property.

Further, in the present embodiment, the NOx purification rate is obtained as the property index, and assuming that the reducing performance of the generated reformed fuel decreases as the NOx purification rate decreases, the operation of the reforming device A1 is controlled so that the NOx purification rate by the NOx purifying device 15 increases. Since the correlation between the NOx purification rate and the fuel property is high, the difference in the fuel property can be reflected on the control of the reforming device A1 with high precision and with a high response.

Further, in the present embodiment, when the NOx purification rate as the property index has a value beyond the normal range at Step 71 of FIG. 9, it is determined that the abnormality occurs in the reforming device A1. When the property index exceeds the normal range, a probability that the reforming device A1 is abnormal is greater than a probability that the fuel property is coarse. For that reason, according to the present embodiment, the abnormality of the reforming device A1 can be detected.

Further in the present embodiment, the reforming device A1 includes the reaction container 30 in which fuel is oxidized with oxygen in air. A temperature within the reaction container 30 and the equivalent ratio are adjusted to generate the cool flame reaction, and fuel (reformed fuel) partially oxidized through the cool flame reaction is supplied into the exhaust passage 10*ex* as the NOx purification reducing agent. For that reason, the NOx purification rate can be improved as compared with a case in which fuel not partially oxidized is used as the reducing agent.

Further, in the present embodiment, the discharging reactor 20 is provided, and ozone generated by the discharging reactor 20 is supplied into the reaction container 30 when the cool flame reaction is generated. For that reason, the start timing of the cool flame reaction can be advanced, and the cool flame reaction time can be reduced. Hence, even when the reaction container 30 is downsized so that a staying time of the fuel within the reaction container 30 is reduced, the cool flame reaction can be completed within the staying time. Thus, the reaction container 30 can be downsized.

Figure 5:
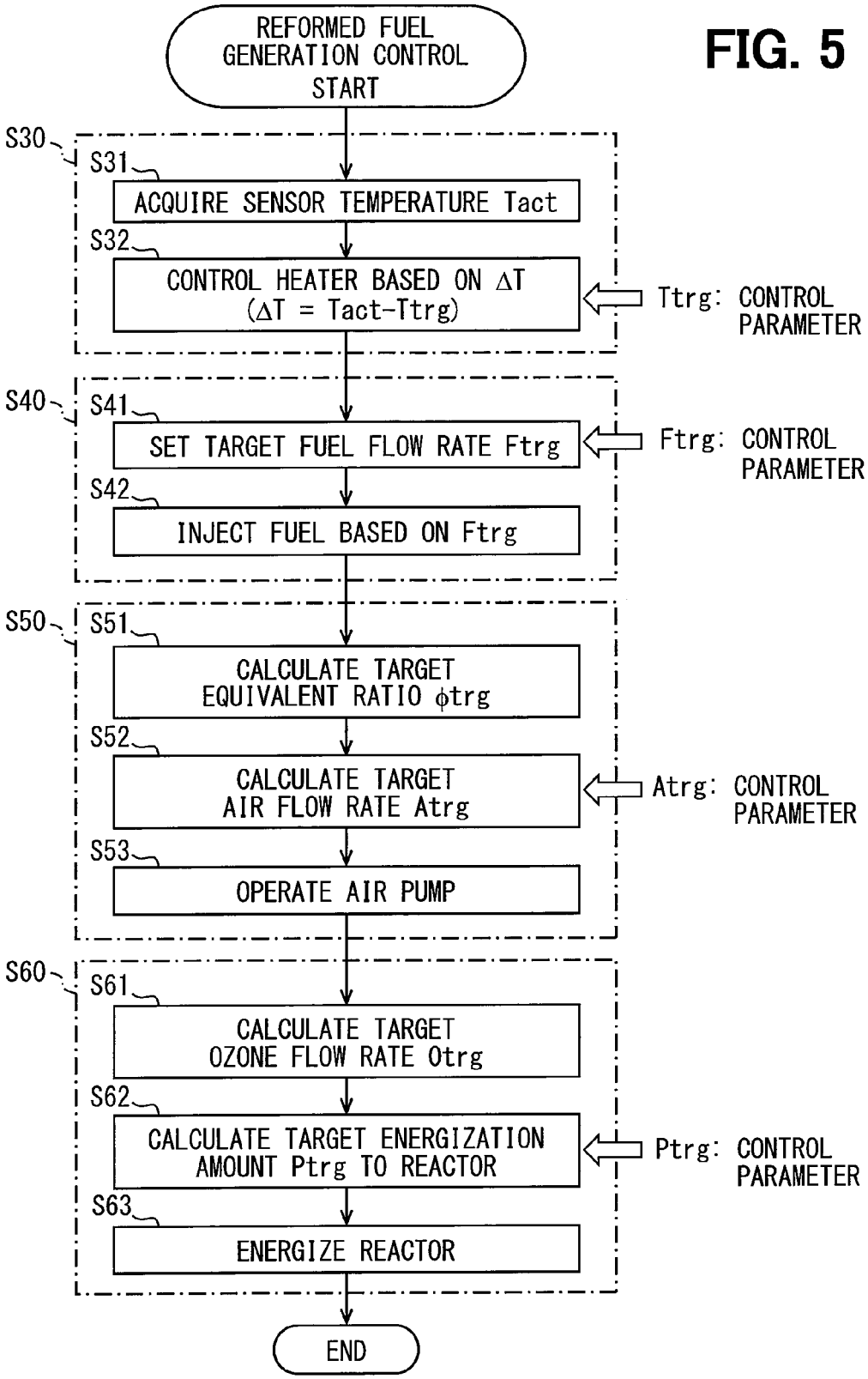
FIG. 5 is a flowchart illustrating a process of a sub-routine of a reformed fuel generation control illustrated in FIG. 4.

Further in the present embodiment, the electric power used for the electric discharge is controlled according to the concentration of fuel in the reaction chamber 30*a* through the process of Step 60 in FIG. 5. For example, the target ozone flow rate Otrg is calculated so that a ratio of the ozone concentration to the fuel concentration becomes a given value (for example, 0.2), and then a discharging power is controlled. For that reason, the excess or deficiency of the ozone concentration to the fuel concentration is suppressed, so that the start of the cool flame reaction can be advanced by supplying the ozone, and the electric consumption at the discharging reactor 20 can be reduced.

Further in the present embodiment, when a temperature of the reducing catalyst is lower than the activation temperature T1, ozone generated by the discharging reactor 20 is supplied into the reaction chamber 30*a* while stopping the fuel injection by the fuel injector 40, thereby supplying ozone into the exhaust passage 10*ex*. Accordingly, the reformed fuel as the reducing agent can be prevented from being supplied when the reducing catalyst in the NOx purifying device 15 is not activated. Since NO in the exhaust gas is oxidized into $NO_2$ by supplying ozone, and is adsorbed inside the NOx purification catalyst, an NOx adsorption amount inside the NOx purifying device 15 can increase.

Further in the present embodiment, the heater 50 that heats the fuel, and the temperature sensor 31 that detects a temperature (ambient temperature) inside the reaction chamber 30*a* are provided. The temperature controller at Step 30 of FIG. 5 controls the operation of the heater 50 according to a temperature detected by the temperature sensor 31, thereby adjusting a temperature inside the reaction chamber 30*a* to a given temperature range. Accordingly, a temperature inside the reaction chamber 30*a* is detected directly by the temperature sensor 31. Also, fuel in the reaction chamber 30*a* is heated directly by the heater 50. For that reason, it can be realized with high precision to adjust a temperature inside the reaction chamber 30*a* to the given temperature range.

It should be noted that the equivalent ratio range where the cool flame reaction occurs may be different depending on a temperature inside the reaction chamber 30*a*. In the present embodiment taking the above fact into consideration, the equivalent ratio controller in Step 50 of FIG. 5 changes the target equivalent ratio ϕtrg according to the detection temperature Tact. For that reason, even when the detection temperature Tact is shifted from the target temperature Ttrg, since the equivalent ratio is adjusted according to an actual temperature in the reaction chamber 30*a*, the cool flame reaction can surely occur.

Further, in the present embodiment, the target fuel flow rate Ftrg is set at Step 40 (fuel injection amount controller) of FIG. 5 based on a flow rate of the reducing agent required by the NOx purifying device 15. The target air flow rate Atrg is set based on the target fuel flow rate Ftrg so that the equivalent ratio falls within a given equivalent ratio range at Step 50 (equivalent ratio controller). For that reason, the equivalent ratio can be adjusted to the given equivalent ratio range while satisfying the flow rate of the reducing agent required by the NOx purifying device 15.

Second Embodiment

In the above-described embodiment, the target fuel flow rate Ftrg (control parameter) is corrected according to the fuel property so that the reducing agent amount to be supplied into the exhaust passage 10*ex* changes according to the fuel property. On the contrary, in the second embodiment, the target temperature Ttrg (control parameter) of the heater 50 is corrected according to the fuel property so that a temperature inside the reaction chamber 30*a* changes according to the fuel property.

Figure 13:
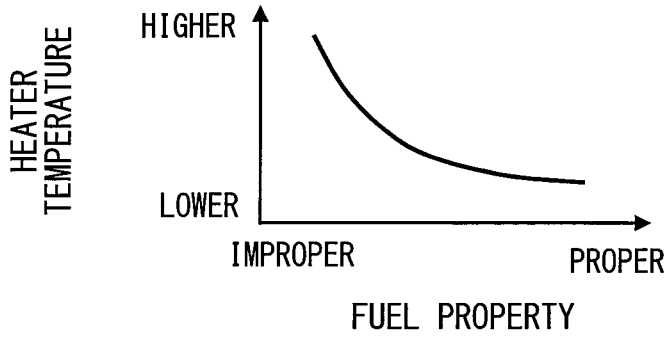
FIG. 13 is a map illustrating a heater temperature suitable for the fuel property.

That is, as illustrated in FIG. 13, the target temperature Ttrg is corrected so that the heater temperature increases when the fuel property are not more suitable for the reduction. For that reason, a temperature inside the reaction chamber 30*a* increases, and the start timing of the cool flame reaction is advanced as illustrated in FIG. 2. Then, since a fuel amount flowing into the exhaust passage 10*ex* without being oxidized by the reaction chamber 30*a* is reduced, a decrease in the NOx purification rate due to the fuel property can be suppressed.

Third Embodiment

In the first and second embodiments, the target fuel flow rate Ftrg or the target temperature Ttrg is corrected according to the fuel property. On the contrary, according to the third embodiment, the target energization amount Ptrg (control parameter) of the discharging reactor 20 is corrected according to the fuel property to change the supply amount of ozone into the reaction chamber 30*a* according to the fuel property.

That is, as illustrated in FIG. 14, the target temperature Ttrg is corrected so that the supply amount of ozone increases when the fuel property is not more suitable for the reduction. For that reason, since the reaction in the reaction chamber 30*a* is accelerated, a fuel amount flowing into the exhaust passage 10*ex* without being oxidized in the reaction chamber 30*a* can be reduced. Hence, a decrease in the NOx purification rate due to the fuel property can be suppressed.

Fourth Embodiment

Figure 15:
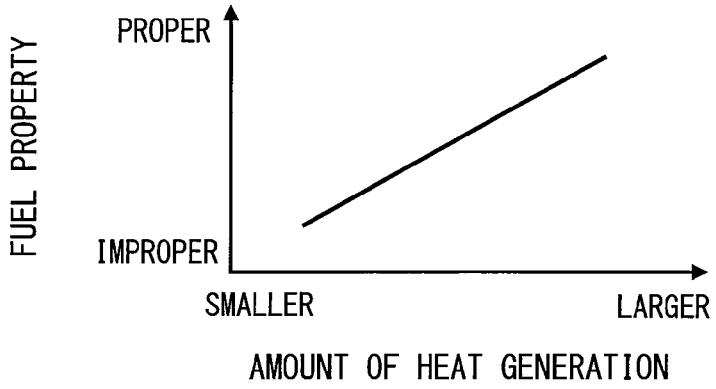
FIG. 15 is a graph illustrating a correlation between a heat generating amount in an internal combustion engine and the fuel property.

In the first embodiment, the NOx purification rate is obtained as the property index. On the contrary, according to the fourth embodiment, a heat generating amount in the combustion chambers of the internal combustion engine 10 is obtained as the property index. Specifically, a heat generating amount in one combustion cycle is estimated based on a pressure within the combustion chambers which is detected by a cylinder pressure sensor, and a variation of a detected value of the engine speed sensor 92. As illustrated in FIG. 15, the control parameter is changed such that the NOx purification rate increases, assuming that the fuel property is not more suitable for the reduction when the estimated heat generating amount is low.

Accordingly, even in the present embodiment, a decrease in the NOx purification rate due to the fuel property can be suppressed. Also, in the present embodiment, since a heat generating amount is obtained as the property index, the property index can be obtained even when a temperature of the reducing catalyst is lower than the activation temperature T1, and the NOx purifying device 15 does not purify NOx.

Further in the present embodiment, the temperature sensor 31 that detects a temperature inside the reaction chamber 30*a* is provided, and the operation of the reforming device changes assuming that a heat generating amount during an oxidization reaction (reaction heat generating amount) decreases as the detection temperature by the temperature sensor 31 decreases. Specifically, the control parameter is changed such that the NOx purification rate increases. According to the above configuration, since a temperature inside the reaction chamber 30*a* is directly detected, the property index corresponding to a heat generating amount can be obtained with high precision.

Fifth Embodiment

Figure 16:
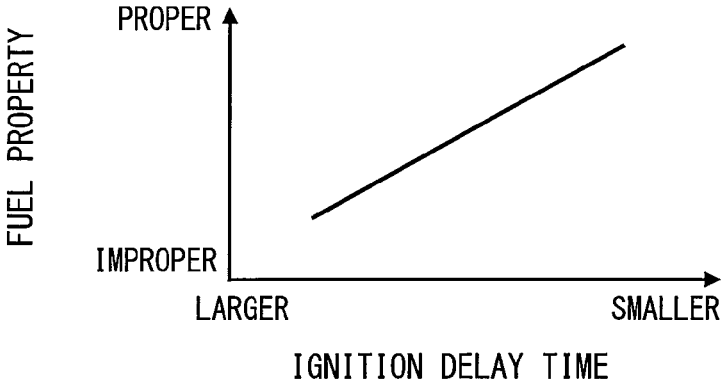
FIG. 16 is a graph illustrating a correlation between an ignition delay time in an internal combustion engine and the fuel property.

In the first and fourth embodiments, the NOx purification rate or the heat generating amount is obtained as the property index. On the contrary, according to the fifth embodiment, an ignition delay time in the combustion chambers of the internal combustion engine 10 is obtained as the property index. Specifically, a time (ignition delay time) from fuel injection into the combustion chambers until self-ignition is calculated based on a pressure change within the combustion chambers, which is detected by the cylinder pressure sensor. As illustrated in FIG. 16, the control parameter is changed such that the NOx purification rate increases, assuming that the fuel property is not more suitable for the reduction as the calculated ignition delay time increases.

Accordingly, even in the present embodiment, a decrease in the NOx purification rate due to the fuel property can be suppressed. Also, in the present embodiment, since the ignition delay time is obtained as the property index, the property index can be obtained even when a temperature of the reducing catalyst is lower than the activation temperature T1, and the NOx purifying device 15 does not purify NOx.

Sixth Embodiment

Figure 17:
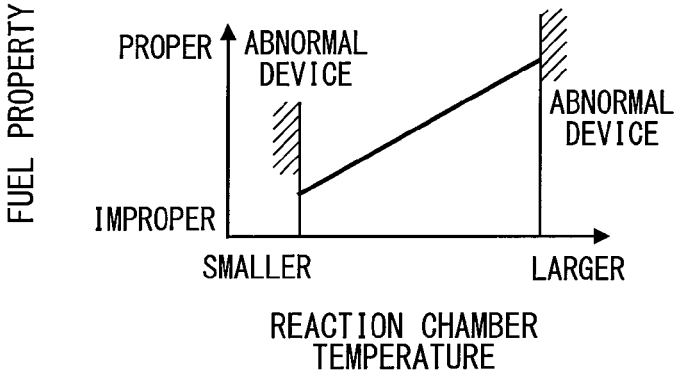
FIG. 17 is a graph illustrating a correlation between a temperature within a reaction chamber and the fuel property.

In the fifth embodiment, the ignition delay time is obtained as the property index. On the contrary, in the present embodiment, a temperature in the reaction chamber 30*a* (reaction chamber temperature), that is, the detection temperature by the temperature sensor 31 is obtained as the property index. The reaction chamber temperature decreases as the reaction heat generating amount when the fuel is oxidized decreases. Under the circumstances, as illustrated in FIG. 17, the control parameter is changed such that the NOx purification rate increases, assuming that the fuel property is not more suitable for the reduction as the reaction chamber temperature decreases. Also, when the reaction chamber temperature is out of the given normal range, it is determined that the reforming device A1 is abnormal. For example, when the reaction chamber temperature is higher than the normal range, a drawback that the fuel is excessively heated due to a failure of the heater 50 or fuel is excessively injected due to a failure of the fuel injector 40 is assumed.

Accordingly, even in the present embodiment, a decrease in the NOx purification rate due to the fuel property can be suppressed. Also, in the present embodiment, the reaction chamber temperature is obtained as the property index, and the reaction chamber temperature has a high correlation with the fuel property. Therefore, the property index with high precision can be obtained.

Seventh Embodiment

Figure 18:
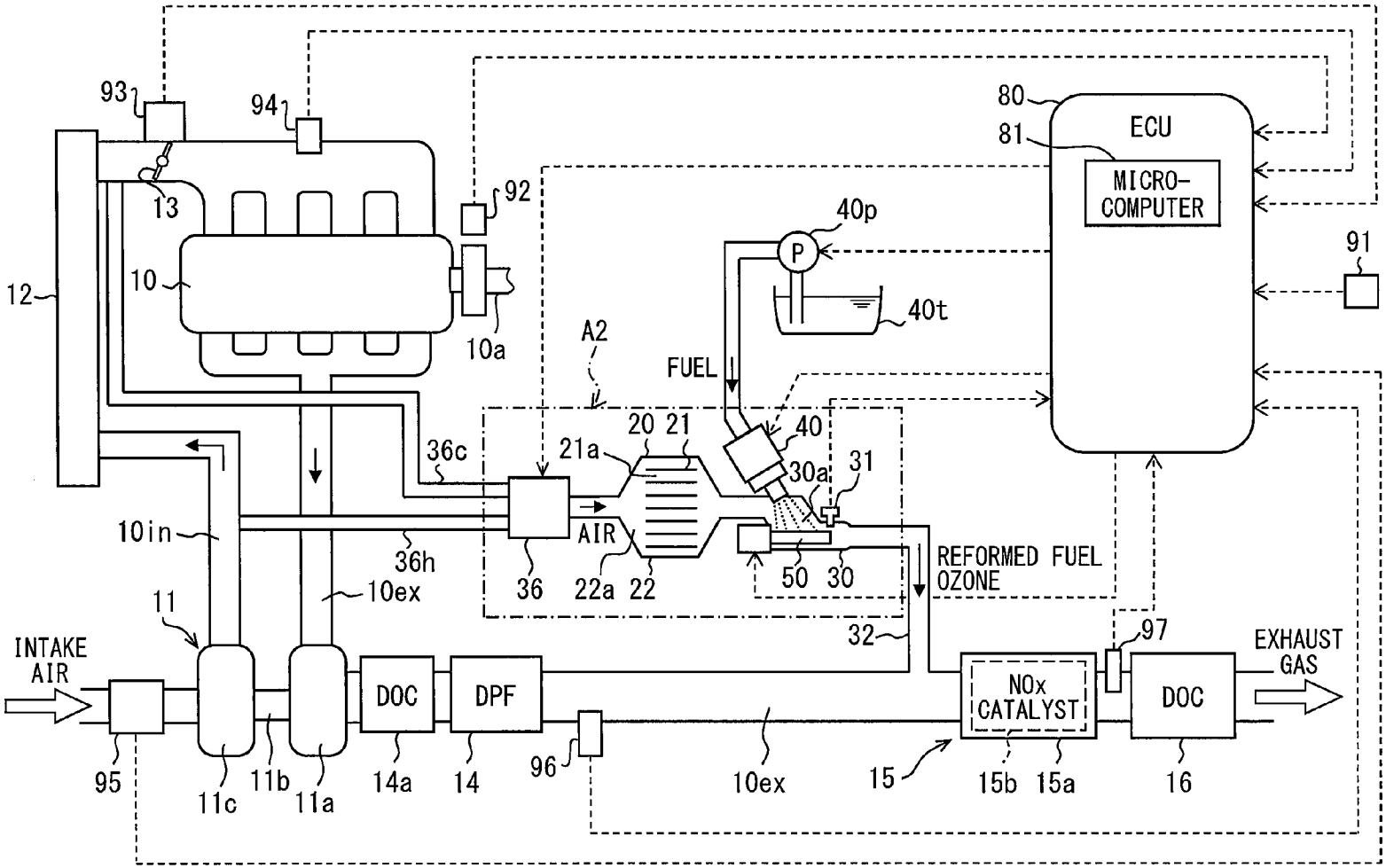
FIG. 18 is a schematic view of a reducing agent supplying device applied to a combustion system.

In the first embodiment illustrated in FIG. 1, air is supplied into the discharging reactor 20 by the air pump 20*p*. On the contrary, in a reducing agent supplying device according to the seventh embodiment illustrated in FIG. 18, a portion of intake air in the internal combustion engine 10 is supplied into the discharging reactor 20.

Specifically, a branch pipe 36*h* connects between a portion of the intake passage 10*in* downstream of the compressor 11*c* and upstream of the cooler 12, and the fluid passage 22*a* of the discharging reactor 20. Also, a branch pipe 36*c* connects between a portion of the intake passage 10*in* downstream of the cooler 12 and the fluid passage 22*a*. A high temperature intake air without being cooled by the cooler 12 is supplied into the discharging reactor 20 through the branch pipe 36*h*. Whereas, a low temperature intake air after being cooled by the cooler 12 is supplied into the discharging reactor 20 through the branch pipe 36*c*.

An electromagnetic valve 36 that opens and closes an internal passage of the respective branch pipes 36*h* and 36*c* is attached to the branch pipes 36*h* and 36*c*. The operation of the electromagnetic valve 36 is controlled by the microcomputer 81. When the electromagnetic valve 36 operates to open the branch pipe 36*h* and close the branch pipe 36*c*, the high temperature intake air flows into the discharging reactor 20. When the electromagnetic valve 36 operates to open the branch pipe 36*c* and close the branch pipe 36*h*, the low temperature intake air flows into the discharging reactor 20.

The operation of the electromagnetic valve 36 allows switching between a mode in which the high temperature intake air without being cooled by the cooler 12 branches off from an upstream of the cooler 12, and a mode in which the low temperature intake air after being cooled by the cooler 12 branches off from a downstream of the cooler 12. In this case, the mode for supplying the low temperature intake air is selected during the ozone generation control, and the generated ozone is prohibited from being destroyed by heat of the intake air. The mode for supplying the high temperature intake air is selected during other than the ozone generation control, and fuel heated by the heater 50 is prohibited from being cooled by the intake air within the reaction chamber 30*a*. Also, the opening of the electromagnetic valve 36 is controlled, thereby controlling an amount of portions of the intake air that is compressed by the supercharger 11 and is to be supplied into the discharging reactor 20.

During a period for which the electromagnetic valve 36 is opened, an amount of intake air that flows into the combustion chambers of the internal combustion engine 10 is reduced by an amount of portions of the intake air that flow through the branch pipes 36*h* and 36*c*. For that reason, the microcomputer 81 corrects the opening of the throttle valve 13 or a compressing amount by the compressor 11*c* so that an amount of intake air flowing into the combustion chambers increases by the amount of the intake air flowing through the branch pipes 36*h* and 36*c* during the opening period of the electromagnetic valve 36.

As described above, a reforming device A2 according to the present embodiment includes the electromagnetic valve 36, and the electromagnetic valve 36 is opened to supply a portion of the intake air compressed by the supercharger 11 into the discharging reactor 20. For that reason, air containing oxygen can be supplied into the discharging reactor 20 without the air pump 20*p* as illustrated in FIG. 1.

Eighth Embodiment

Figure 19:
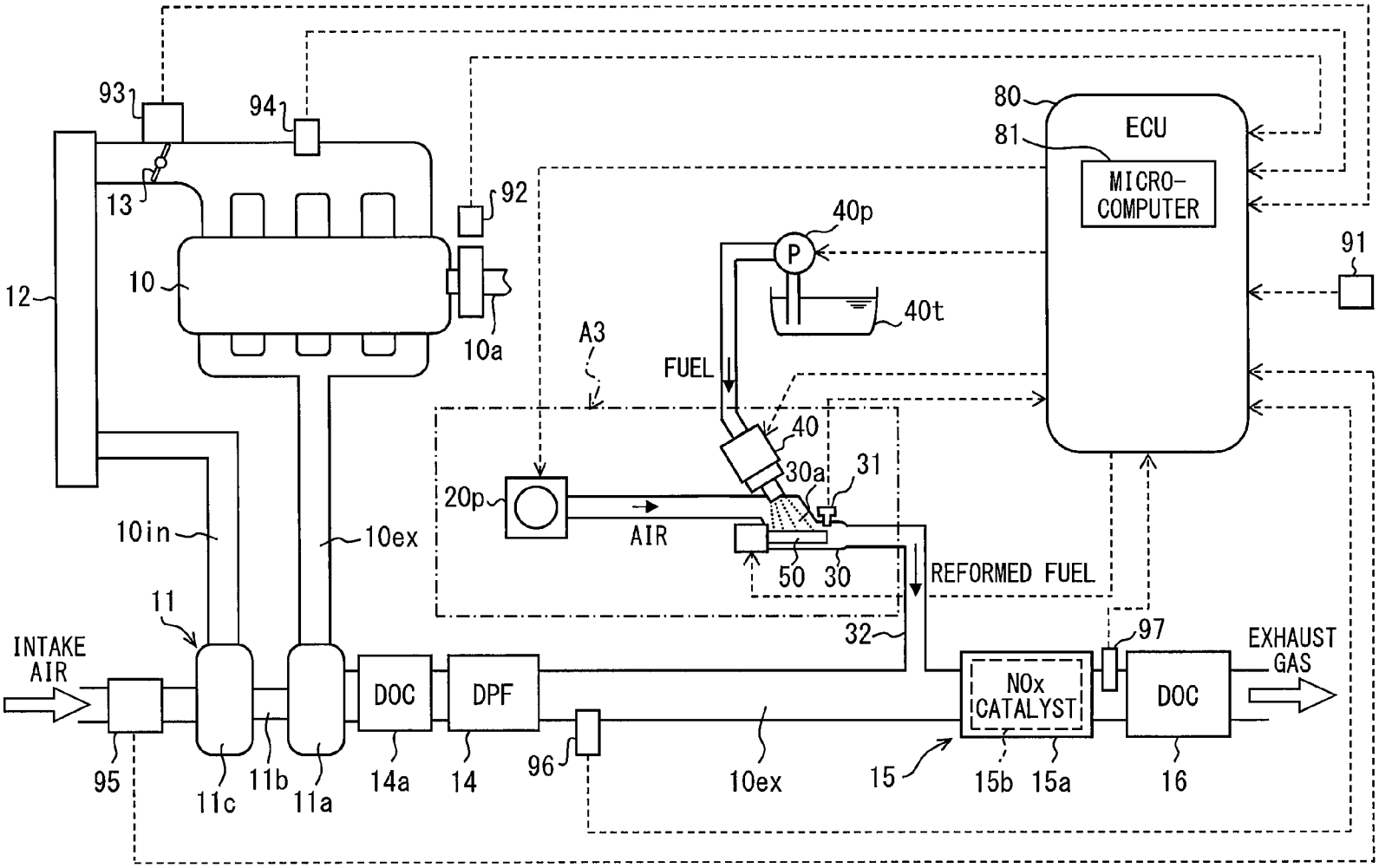
FIG. 19 is a schematic view of a reducing agent supplying device applied to a combustion system.

The reforming device A1 illustrated in FIG. 1 generates ozone by the discharging reactor 20, and supplies the generated ozone into the reaction chamber 30*a* so as to accelerate the oxidation reaction of fuel. On the contrary, in a reforming device A3 according to the eighth embodiment, the discharging reactor 20 is eliminated, and ozone is not supplied into the reaction chamber 30*a*, as illustrated in FIG. 19. In this way, even in the reforming device A3 without the discharging reactor 20, when the control parameter is changed according to the property index, a decrease in the NOx purification rate due to the fuel property can be suppressed.

Ninth Embodiment

Figure 20:
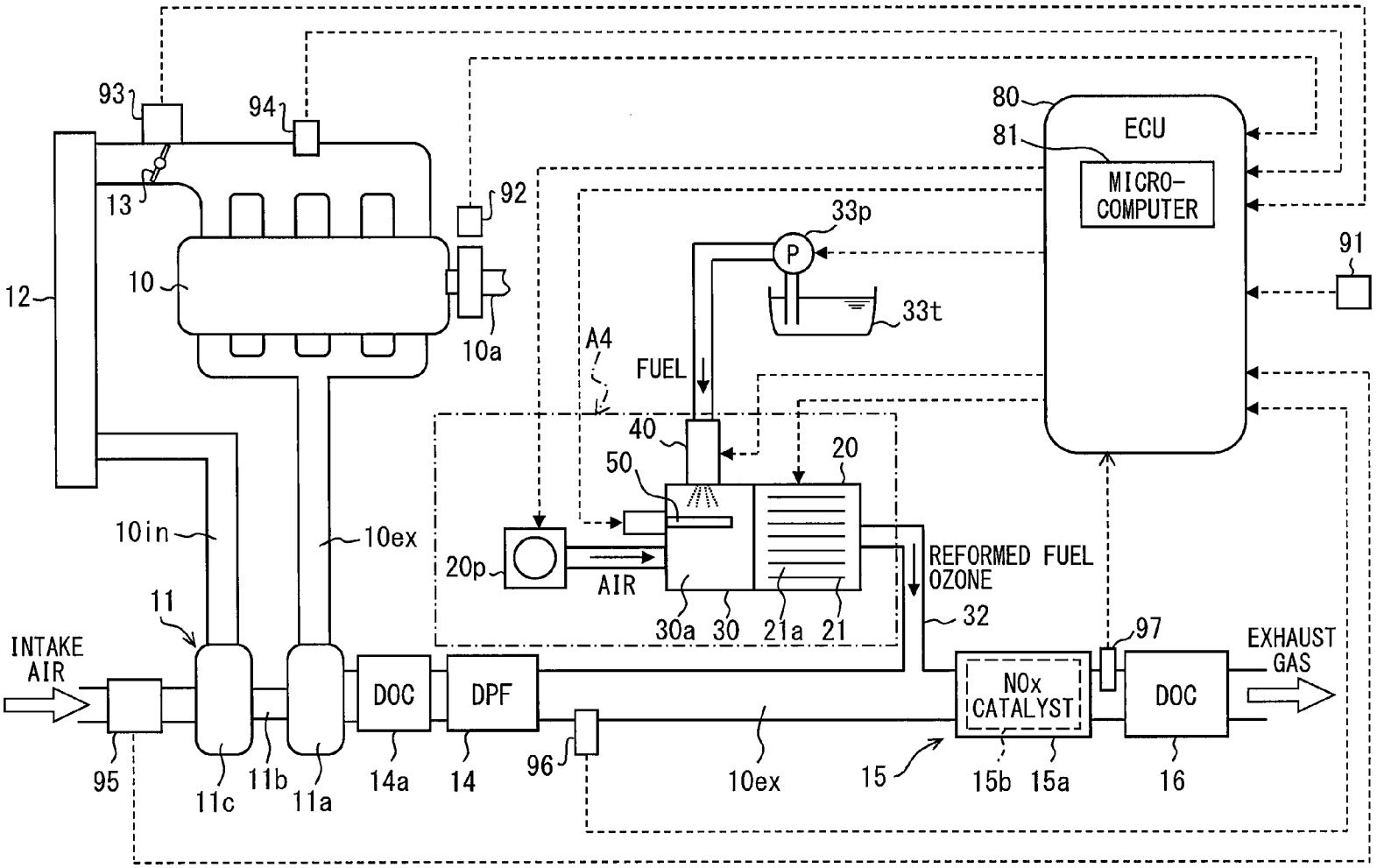
FIG. 20 is a schematic view of a reducing agent supplying device applied to a combustion system.

In the reforming device A1 illustrated in FIG. 1, the discharging reactor 20 is disposed upstream of the reaction chamber 30*a* in an air flow direction. On the contrary, in a reforming device A4 according to the ninth embodiment, the discharging reactor 20 is disposed downstream of the reaction chamber 30*a* in the air flow direction, as illustrated in FIG. 20. In the reforming device A4, the oxidation reaction slightly occurs within the reaction chamber 30*a*, and the oxidation reaction mainly occurs within the discharging passages 21*a* of the discharging reactor 20. In the discharging passages 21*a*, oxygen molecules in air are ionized, and fuel is oxidized under the circumstance where the ionized active oxygen atoms exist. Therefore, in the discharging reactor 20, a portion of fuel is oxidized and the reformed fuel is generated. In this way, even in the reforming device A4 that reforms fuel inside the discharging reactor 20, a decrease in the NOx purification rate due to the fuel property can be suppressed by adjusting the control parameter according to the property index.

Other Embodiments

The preferred embodiments of the present invention have been described above. However, the present invention is not limited to the embodiments described above, but can be implemented with various modifications as exemplified below.

In the above-described embodiments, any one of the control parameters of the target temperature Ttrg, the target fuel flow rate Ftrg, the target air flow rate Atrg, and the target energization amount Ptrg is changed according to the property index. On the contrary, the plural control parameters may be changed according to the property index.

In the embodiment illustrated in FIG. 1, the heater 50 is arranged within the reaction container 30. Alternatively, the heater 50 may be arranged outside of the reaction container 30 so that fuel or air is heated at a position upstream of the reaction container 30. Also, in the embodiment illustrated in FIG. 1, the temperature sensor 31 is arranged within the reaction container 30. Alternatively, the temperature sensor 31 may be arranged at a position downstream of the reaction container 30.

In the above-described embodiment as shown in FIG. 1, the fuel injector 40 is used as the atomizer that atomizes hydrocarbon in liquid form and supplies the atomized hydrocarbon to the heater. A vibrating device that atomizes fuel in liquid form by vibrating the fuel may be used as the atomizer. The vibrating device may have a vibrating plate that vibrates at a high frequency and fuel is vibrated on the vibrating plate.

In the above-described embodiment illustrated in FIG. 15, intake air branches off from two portions of the intake passage 10*in* upstream and downstream of the cooler 12 through the branch pipes 36*h* and 36*c*. On the contrary, any one of the two branch pipes 36*h* and 36*c* may be eliminated, and the switching of the modes by the electromagnetic valve 36 may be also eliminated.

When the reducing agent supplying device is in a complete stop state in which generation of both the ozone and the reformed reducing agent is stopped, the electric discharge at the discharging reactor 20 may be stopped to reduce wasteful electric consumption. The reducing agent supplying device may be in the complete stop state when, for example, the NOx catalyst temperature is lower than the activation temperature and the NOx adsorbed amount reaches the saturation amount, or when the NOx catalyst temperature becomes high beyond a max temperature at which the reducing catalyst can reduce NOx. Further, the operation of the air pump 20*p* may be stopped in the complete stop state so as to reduce wasteful power consumption.

In the above-described embodiment as shown in FIG. 1, the reducing catalyst that physically adsorbs NOx (i.e., physisorption) is used in the NOx purifying device 15, but a reducing agent that chemically adsorbs NOx (i.e., chemisorption) may be used.

The NOx purifying device 15 may adsorb NOx when an air-fuel ratio in the internal combustion engine 10 is leaner than a stoichiometric air-fuel ratio (i.e., when the engine 10 is in lean combustion) and may reduce NOx when the air-fuel ratio in the internal combustion engine 10 is not leaner than the stoichiometric air-fuel ratio (i.e., when the engine 10 is in non-lean combustion). In this case, ozone is generated at the lean combustion and the reformed reducing agent is generated at the non-lean combustion. One of examples of a catalyst that adsorbs NOx at the lean combustion may be a chemisorption reducing catalyst made of platinum and barium carried by a carrier.

The reducing agent supplying device may be applied to a combustion system that has the NOx purifying device 15 without adsorption function (i.e., physisorption and chemisorption functions). In this case, in the NOx purifying device 15, an iron-based or copper-based catalyst may be used as the catalyst having the NOx reducing performance in a given temperature range in the lean combustion, and a reforming substance may be supplied to those catalysts as the reducing agent.

In the above-described embodiment, the NOx catalyst temperature used at Step 12 of FIG. 12 is estimated based on the exhaust temperature detected by the exhaust temperature sensor 96. However, a temperature sensor may be attached to the NOx purifying device 15, and the temperature sensor may detect directly the NOx catalyst temperature. Or, the NOx catalyst temperature may be estimated based on a rotational speed of the output shaft 10*a* and an engine load of the internal combustion engine 10.

In the above-described embodiment as shown in FIG. 1, the discharging reactor 20 has the electrodes 21, each of which has a plate shape and faces each other in parallel. However, the discharging reactor 20 may have an acicular electrode (pin electrode) protruding in an acicular manner and an annular electrode annularly surrounding the acicular electrode.

In the above-described embodiment as shown in FIG. 1, the reducing agent supplying device is applied to the combustion system that is installed in a vehicle. However, the active substance supplying system may be applied to a stationary combustion system. Further, in the embodiments as shown in FIG. 1, the reducing agent supplying device is applied to a compression self-ignition diesel engine, and diesel for combustion is used as the reducing agent. However, the reducing agent supplying device may be applied to a self-ignition gasoline engine, and gasoline for combustion may also be used for the reducing agent.

Means and functions provided by the ECU may be provided by, for example, only software, only hardware, or a combination thereof. The ECU may be constituted by, for example, an analog circuit.

What is claimed is:

1. A reducing agent supplying device for a fuel combustion system that includes a NOx purifying device with a reducing catalyst arranged in an exhaust passage to purify NOx contained in exhaust gas of an internal combustion engine, the reducing agent supplying device supplying a reducing agent into the exhaust passage at a position upstream of the reducing catalyst, the reducing agent supplying device comprising:

a reforming device that is configured to mix fuel, which is a hydrocarbon compound, with air into a mixture and that reforms the fuel by partially oxidizing the fuel with oxygen in the air, wherein the reforming device is configured to supply a reformed fuel into the exhaust passage as the reducing agent; and an electronic control unit that is configured to obtain a physical quantity as a property index, the physical quantity having a correlation with a property of the fuel that is supplied to the reforming device; and control the reforming device according to the property index obtained by the electronic control unit; wherein the reforming device includes an ozone generator that is configured to generate ozone in the air, the electronic control unit being configured to control the ozone generator to adjust a generation amount of the ozone to a target generation amount, and the electronic control unit is configured to change the target generation amount according to the property index when controlling the ozone generator.

2. The reducing agent supplying device according to claim 1, wherein the reforming device includes a heater that is configured to heat the mixture of the fuel and the air, the electronic control unit being configured to control the heater being to adjust a temperature of the mixture to a target temperature, wherein the electronic control unit is configured to change the target temperature according to the property index when controlling the heater.

3. The reducing agent supplying device according to claim 1, wherein the reforming device includes a reaction container having a reaction chamber therein, the reaction chamber being configured to mix the fuel with the air and oxidize the fuel with oxygen in the air, and a fuel injector configured to inject the fuel into the reaction chamber, the electronic control unit being configured to control the fuel injector to adjust a fuel injection amount into the reaction chamber to a target injection amount, and the electronic control unit is configured to change the target injection amount according to the property index when controlling the fuel injector.

4. The reducing agent supplying device according to claim 1, wherein the electronic control unit is configured to obtain an NOx purification rate in the NOx purifying device as the property index, and the electronic control unit is configured to control the reforming device to increase the NOx purification rate.

5. The reducing agent supplying device according to claim 1, wherein the reducing agent supplying device is configured to use fuel used for combustion of the internal combustion engine as the fuel that is to be supplied to the reforming device, the electronic control unit is configured to obtain an ignition delay time in the internal combustion engine as the property index, and the electronic control unit is configured to control the reforming device such that an NOx purification rate in the NOx purifying device increases as the ignition delay time increases.

6. The reducing agent supplying device according to claim 1, wherein the electronic control unit is configured to determine abnormality in the reforming device or the NOx purification device when the property index has a value beyond a predetermined normal range.

7. A reducing agent supplying device for a fuel combustion system that includes a NOx purifying device with a reducing catalyst arranged in an exhaust passage to purify NOx contained in exhaust gas of an internal combustion engine, the reducing agent supplying device supplying a reducing agent into the exhaust passage at a position upstream of the reducing catalyst, the reducing agent supplying device comprising:

a reforming device that is configured to mix fuel, which is a hydrocarbon compound, with air into a mixture and that reforms the fuel by partially oxidizing the fuel with oxygen in the air, wherein the reforming device is configured to supply a reformed fuel into the exhaust passage as the reducing agent; and an electronic control unit configured to obtain a physical quantity as a property index, the physical quantity having a correlation with a property of the fuel that is supplied to the reforming device; and control the reforming device according to the property index obtained by the electronic control unit;

wherein the electronic control unit is configured to obtain the property index that has a correlation with a heat generating amount during a oxidization reaction of the fuel with oxygen, and the electronic control unit is configured to control the reforming device such that an NOx purification rate in the NOx purifying device increases as the heat generating amount during the oxidization reaction decreases.

8. The reducing agent supplying device according to claim 7, wherein the reforming device includes a reaction container having a reaction chamber therein, the reaction chamber being configured to mix the fuel with the air and oxidize the fuel with oxygen in the air, and a temperature sensor configured to detect a temperature inside the reaction chamber, and the electronic control unit is configured to control the reforming device assuming that the heat generating amount during the oxidization reaction decreases as a detection temperature by the temperature sensor decreases.

9. The reducing agent supplying device according to claim 7, wherein the reforming device includes a heater that is configured to heat the mixture of the fuel and the air, the electronic control unit being configured to control the heater being to adjust a temperature of the mixture to a target temperature, wherein the electronic control unit is configured to change the target temperature according to the property index when controlling the heater.

10. The reducing agent supplying device according to claim 7, wherein the reforming device includes a reaction container having a reaction chamber therein, the reaction chamber being configured to mix the fuel with the air and oxidize the fuel with oxygen in the air, and a fuel injector configured to inject the fuel into the reaction chamber, the electronic control unit being configured to control the fuel injector to adjust a fuel injection amount into the reaction chamber to a target injection amount, and the electronic control unit is configured to change the target injection amount according to the property index when controlling the fuel injector.

11. The reducing agent supplying device according to claim 7, wherein the electronic control unit is configured to obtain an NOx purification rate in the NOx purifying device as the property index, and the electronic control unit is configured to control the reforming device to increase the NOx purification rate.

12. The reducing agent supplying device according to claim 7, wherein the reducing agent supplying device is configured to use fuel used for combustion of the internal combustion engine as the fuel that is to be supplied to the reforming device, the electronic control unit is configured to obtain an ignition delay time in the internal combustion engine as the property index, and the electronic control unit is configured to control the reforming device such that an NOx purification rate in the NOx purifying device increases as the ignition delay time increases.

13. The reducing agent supplying device according to claim 7, wherein:

the electronic control unit is configured to determine abnormality in the reforming device or the NOx purification device when the property index has a value beyond a predetermined normal range.

14. A reducing agent supplying device for a fuel combustion system that includes a NOx purifying device with a reducing catalyst arranged in an exhaust passage to purify NOx contained in exhaust gas of an internal combustion engine, the reducing agent supplying device supplying a reducing agent into the exhaust passage at a position upstream of the reducing catalyst, the reducing agent supplying device comprising:

a reforming device that is configured to mix fuel, which is a hydrocarbon compound, with air into a mixture and that reforms the fuel by partially oxidizing the fuel with oxygen in the air, wherein the reforming device is configured to supply a reformed fuel into the exhaust passage as the reducing agent; and an electronic control unit configured to obtain a physical quantity as a property index, the physical quantity having a correlation with a property of the fuel that is supplied to the reforming device; and control the reforming device according to the property index obtained by the electronic control unit; wherein the reducing agent supplying device is configured to use fuel used for combustion of the internal combustion engine is-used-as the fuel that is to be supplied to the reforming device, the electronic control unit is configured to obtain a heat generating amount in the internal combustion engine as the property index, and the electronic control unit is configured to control the reforming device such that an NOx purification rate in the NOx purifying device increases as the heat generating amount in the internal combustion engine decreases.

15. The reducing agent supplying device according to claim 14, wherein the reforming device includes a heater that is configured to heat the mixture of the fuel and the air, the electronic control unit being configured to control the heater being to adjust a temperature of the mixture to a target temperature, wherein the electronic control unit is configured to change the target temperature according to the property index when controlling the heater.

16. The reducing agent supplying device according to claim 14, wherein the reforming device includes a reaction container having a reaction chamber therein, the reaction chamber being configured to mix the fuel with the air and oxidize the fuel with oxygen in the air, and a fuel injector configured to inject the fuel into the reaction chamber, the electronic control unit being configured to control the fuel injector to adjust a fuel injection amount into the reaction chamber to a target injection amount, and the electronic control unit is configured to change the target injection amount according to the property index when controlling the fuel injector.

17. The reducing agent supplying device according to claim 14, wherein the electronic control unit is configured to obtain an NOx purification rate in the NOx purifying device as the property index, and the electronic control unit is configured to control the reforming device to increase the NOx purification rate.

18. The reducing agent supplying device according to claim 14, wherein the reducing agent supplying device is configured to use fuel used for combustion of the internal combustion engine as the fuel that is to be supplied to the reforming device, the electronic control unit is configured to obtain an ignition delay time in the internal combustion engine as the property index, and the electronic control unit is configured to control the reforming device such that an NOx purification rate in the NOx purifying device increases as the ignition delay time increases.

19. The reducing agent supplying device according to claim 14, wherein:

the electronic control unit is configured to determine abnormality in the reforming device or the NOx purification device when the property index has a value beyond a predetermined normal range.

* * * * *